US011073340B2

(12) United States Patent
Kandlikar et al.

(10) Patent No.: US 11,073,340 B2
(45) Date of Patent: Jul. 27, 2021

(54) PASSIVE TWO PHASE HEAT TRANSFER SYSTEMS

(71) Applicants: Satish G. Kandlikar, Rochester, NY (US); Aranya Chauhan, Rochester, NY (US); Travis Emery, Rochester, NY (US); Arvind Jaikumar, Rochester, NY (US); Pruthvik Raghupathi, Rochester, NY (US)

(72) Inventors: Satish G. Kandlikar, Rochester, NY (US); Aranya Chauhan, Rochester, NY (US); Travis Emery, Rochester, NY (US); Arvind Jaikumar, Rochester, NY (US); Pruthvik Raghupathi, Rochester, NY (US)

(73) Assignee: Rochester Institute of Technology, Rochester, NY (US)

( * ) Notice: Subject to any disclaimer, the term of this patent is extended or adjusted under 35 U.S.C. 154(b) by 309 days.

(21) Appl. No.: 16/437,171

(22) Filed: Jun. 11, 2019

(65) Prior Publication Data

US 2019/0293358 A1 Sep. 26, 2019

Related U.S. Application Data

(63) Continuation-in-part of application No. 12/925,584, filed on Oct. 25, 2010, now abandoned.

(Continued)

(51) Int. Cl.
*F28D 15/02* (2006.01)
*F28F 13/06* (2006.01)

(Continued)

(52) U.S. Cl.
CPC ..... *F28D 15/0266* (2013.01); *F28F 13/06* (2013.01); *F28D 15/046* (2013.01);

(Continued)

(58) Field of Classification Search
CPC ..... F28D 15/0266; F28F 13/187; F28F 13/06; F28F 3/02; F28F 3/022

(Continued)

(56) References Cited

U.S. PATENT DOCUMENTS 4,050,507 A * 9/1977 Chu ..... F28F 13/187 165/96
4,059,147 A * 11/1977 Thorne ..... B21C 37/207 165/133

(Continued)

FOREIGN PATENT DOCUMENTS

JP 52037260 A * 3/1977
JP 59084095 A * 5/1984 ..... B01D 1/22

OTHER PUBLICATIONS

JP-52037260-A abstract translation.*

(Continued)

*Primary Examiner* — Jon T. Schermerhorn, Jr.
(74) *Attorney, Agent, or Firm* — Bond, Schoeneck & King, PLLC; Joseph Noto

(57) ABSTRACT

A method and apparatus for pool boiling includes introducing a fluid into a chamber of a housing which has one or more protruding features. One or more diverters extend at least partially across the one or more protruding features in the chamber. One or more bubbles are formed in the fluid in the chamber as a result of bubble nucleation. At least one of growth and motion of the one or more of the bubbles are diverted with the one or more diverters to generate additional localized motion of the fluid along at least one of the one or more protruding features and other surfaces in the chamber of the housing to at least of transfer additional heat to the liquid and increase the critical heal flux limit.

20 Claims, 17 Drawing Sheets

Related U.S. Application Data

(60) Provisional application No. 62/683,316, filed on Jun. 11, 2018.

(51) Int. Cl.
*F28F 1/14* (2006.01)
*F28F 3/02* (2006.01)
*F28D 15/04* (2006.01)
*F28F 13/18* (2006.01)

(52) U.S. Cl.
CPC ..... *F28F 1/14* (2013.01); *F28F 3/022* (2013.01); *F28F 13/187* (2013.01)

(58) Field of Classification Search
USPC ..... 165/104.29, 104.21, 104.28, 185, 186
See application file for complete search history.

(56) References Cited

U.S. PATENT DOCUMENTS 4,288,897 A * 9/1981 Withers, Jr. ..... B23P 15/26 165/133
4,606,405 A * 8/1986 Nakayama ..... F28F 13/187 165/133
4,653,163 A * 3/1987 Kuwahara ..... B21J 5/068 29/890.05
5,351,397 A * 10/1994 Angeli ..... B21B 1/227 29/890.046
5,814,392 A * 9/1998 You ..... B05D 5/02 427/386
5,871,043 A * 2/1999 Osakabe ..... F28D 15/0266 165/104.21
6,382,309 B1 5/2002 Kroliczek et al.
6,427,767 B1 * 8/2002 Mougin ..... F28F 1/36 165/133
6,457,516 B2 * 10/2002 Brand ..... F28F 13/187 165/133
6,466,442 B2 10/2002 Lin
6,549,408 B2 4/2003 Berchowitz
6,719,040 B2 * 4/2004 Sugito ..... F28D 15/0266 165/104.21
6,729,383 B1 * 5/2004 Cannell ..... F28F 3/022 165/185
6,903,929 B2 * 6/2005 Prasher ..... H01L 23/4006 361/699
6,967,840 B2 * 11/2005 Chrysler ..... H01L 23/473 165/80.4
6,990,816 B1 1/2006 Zuo et al.
7,002,801 B2 * 2/2006 Zeighami ..... F28D 15/0266 165/104.33
7,261,144 B2 * 8/2007 Thome ..... F28D 15/0266 165/104.21
7,265,979 B2 * 9/2007 Erturk ..... H01L 23/427 257/713
7,455,101 B2 11/2008 Hsu
7,721,543 B2 * 5/2010 Massey ..... F01P 9/06 60/618
7,885,074 B2 2/2011 Campbell et al.
7,926,553 B2 4/2011 Dautert et al.
7,958,935 B2 6/2011 Belits et al.
7,980,078 B2 7/2011 McCutchen et al.
8,256,501 B2 * 9/2012 Nagai ..... F28D 15/0233 165/80.4
8,345,425 B2 1/2013 Toyoda et al.
8,964,391 B2 2/2015 Campbell et al.
9,078,379 B2 7/2015 Campbell et al.
9,500,414 B2 11/2016 Tonkovich et al.
10,018,428 B2 7/2018 Altman et al.
2002/0000312 A1 * 1/2002 Brand ..... F28F 13/187 165/179
2005/0173098 A1 8/2005 Connors
2005/0211417 A1 * 9/2005 Upadhya ..... F28D 15/0266 165/80.4
2005/0211418 A1 * 9/2005 Kenny ..... F28D 15/00 165/80.4
2007/0163754 A1 7/2007 Dionne et al.
2009/0145581 A1 * 6/2009 Hoffman ..... H01L 23/473 165/80.3
2010/0018678 A1 1/2010 Siu
2012/0097373 A1 * 4/2012 Kandlikar ..... F28F 3/02 165/104.29
2016/0033212 A1 2/2016 Wang et al.
2016/0381839 A1 12/2016 Farshchian et al.
2019/0014688 A1 1/2019 Weibel et al.

OTHER PUBLICATIONS

JP-59084095-A abstract translation.*
Khrustalev. Loop Thermosyphons for Cooling of Electronics. IEEE / 2002. pp. 145-150.
Agostini et al. Compact Gravity Driven and Capillary-Sized Thermosyphon Loop for Power Electronics Cooling. ASME / 2013.pp. 1-7.
Tsai et al. Two-phase closed thermosyphon vapor-chamber system for electronic cooling. International Communications in Heat and Mass Transfer / 2010. pp. 484-489.
Chu et al. Experimental Investigation of an Enhanced Thermosyphon Heat Loop for Cooling of a High Performance Electronics Module. IEEE / 1999. pp. 1-9.
Ong et al. Two-Phase Mini-Thermosyphon Electronics Cooling, Part 1: Experimental Investigation. IEEE / 2016. pp. 574-582.
Liu et al. Experimental Study on Thermosyphon for Shipboard High-Power Electronics Cooling System. Heat Transfer Engineering / 2013. pp. 1077-1083.
Pal et al. Design and Performance Evaluation of a Compact Thermosyphon. IEEE / 2002. pp. 601-607.
Khodabandefi et al. Heat transfer in the evaporator of an advanced two-phase thermosyphon loop. International Journal of Refrigeration / 2004. pp. 190-202.
Battaglia et al. Comparison of near source two-phase flow cooling of power electronics in thermosiphon and forced convection models. IEEE / 2017. pp. 752-759.
Kalani et al. Effect of taper on pressure recovery during flow boiling in open microchannels with manifold using homogeneous flow model. International Journal of Heat and Mass Transfer, 2014. pp. 109-117.

* cited by examiner

PASSIVE TWO PHASE HEAT TRANSFER SYSTEMS

CROSS REFERENCE

This application claims the benefit of the filing date of U.S. Provisional Patent Application No. 62/683,316, filed Jun. 11, 2018, which is hereby incorporated by reference in its entirety and is a continuation-in-part of U.S. patent application Ser. No. 12/925,584, filed Oct. 25, 2010, which is hereby incorporated by reference in its entirety.

FIELD

This technology generally relates to methods and device for improving pool boiling and, more particularly, methods for at least one of improving heat transfer and increasing critical heat flux in pool boiling and apparatuses thereof.

BACKGROUND

In a cooling system with a network of multiple flow passages, a fluid used for cooling is introduced. The fluid may be single-phase liquid, gas or a two-phase liquid-vapor mixture. As the fluid flows through the network, heat transfer is by convection from the heated walls. The heat transfer rate to the fluid from the heated walls is characterized by the heat transfer coefficient. Higher heat transfer coefficients are desired for higher heat dissipation rates. Additionally, providing smaller channel internal dimensions leads to higher single phase heat transfer performance.

Employing liquid as the introduced fluid results in a higher heat transfer rate than with gas for the same flow conditions due to the higher thermal conductivity of liquids as compared to gases. To further improve this heat transfer rate and take advantage of the large latent heat of vaporizations compared to the sensible heat transfer with a few degrees temperature change, flow boiling can be employed. Heat transfer by flow boiling occurs when the liquid is forced to flow in the passages and boiling of the liquid occurs. This flow requires an external mechanism, such as a pump, to drive the liquid and vapor mixture through the passages. Due to the confined nature of the flow boiling system, sometimes backflow occurs in one or more channels causing the liquid to flow in a backward direction. This condition can lead to a critical heat flux condition at relatively low heat fluxes.

Pressure drop through a cooling system with flow boiling is also often a concern. As a result, efforts are made to reduce the pressure drop and/or external pumping power to achieve a desired cooling performance. Pressure drop also affects the saturation temperature of the liquid as it flows through the cooling system. Short passage lengths are desirable to reduce the pressure drop in a flow boiling system. However, reducing the passage length requires large number of inlets and outlets. As a result, the header design for flow boiling cooling systems can become quite complex.

In contrast, heat transfer by pool boiling occurs without any external pumping when a heated surface, which presents no enclosed channels to contain the liquid, is cooled by the liquid and boiling of the liquid occurs. When the bulk of the liquid is at its saturation temperature corresponding to the existing pressure in the liquid and boiling occurs on the heated surface, heat transfer is by saturated pool boiling mode. When the bulk of the liquid is at a temperature below the saturation temperature corresponding to the existing pressure in the liquid and boiling occurs over the heated surface, heat transfer is by subcooled pool boiling. Pool boiling covers both subcooled and saturated pool boiling. Boiling covers both pool and flow boiling.

Pool boiling can occur when nucleating bubbles are generated over the heated surface in a liquid environment, when the liquid superheat exceeds the nucleation criterion. Another method of generating nucleating bubbles is to provide localized microheaters in conjunction with a natural or artificial nucleation cavity. The heating of liquid around the cavity above the liquid saturation temperature leads to bubble nucleation when the nucleation criterion for the cavity is satisfied.

In addition to a natural convection mechanism over the portion of the heater surface that is unaffected by the nucleation activity, heat transfer in pool boiling generally occurs as a result of three mechanisms: microconvection caused by convection currents induced by a bubble; transient conduction caused by the transient heat transfer to the fresh liquid that displaces the heated liquid over the heated surface in the region of nucleating bubbles; and microlayer evaporation caused by the evaporation of a thin liquid layer that appears underneath the nucleating bubble. A significant portion of the heat transfer during pool boiling occurs due to microconvection and transient conduction modes. The heat transfer by all these mechanisms aid in transferring heat from the heater surface and evaporating liquid into the growing vapor bubbles.

Another method of heat transfer involves introducing gas bubbles (not resulting from boiling) that grow and depart in the liquid in the vicinity of a heated surface and create motion at the liquid-gas interface. However, evaporation is not the primary mechanism in this case as the temperatures are generally below the saturation temperature of the liquid at the system pressure. The absence of evaporation in these systems with introduced gas bubbles results in considerably lower heat transfer rates as compared to pool boiling. Nevertheless, the heat transfer rate in such systems is still higher than that in systems with stagnant liquids.

To enhance pool boiling, surface features protruding from a base, such as pin fins of various cross sections, offset strip fins with rectangular pin fins arranged in staggered fashion, and other fin configurations, can be employed to enhance pool boiling. Additionally, to enhance pool boiling heat transfer fins, porous surfaces and active nucleation sites formed on the heated surface can be employed.

The maximum heat that can be dissipated with boiling without causing excessive temperature rise is limited by the Critical Heat Flux (CHF). It is desirable to increase the CHF limit during boiling. This limit is also an important consideration in the design of a boiling system.

The CHF limit can be increased by changing the contact angle of the liquid-vapor interface of a growing bubble. Increasing wettability of a surface by reducing the contact angle leads to enhancement of CHF. Reducing the wettability leads to a decrease in CHF.

SUMMARY

A method for pool boiling includes introducing a liquid into a chamber of a housing which has one or more protruding features. One or more diverters extend at least partially across the one or more protruding features in the chamber. One or more bubbles are formed in the liquid in the chamber as a result of bubble nucleation. One or more of the bubbles resulting from nucleation are diverted with the one or more diverters to generate additional localized motion of the liquid along at least one of the one or more protruding features and other surfaces in the chamber of the housing to at least one of transfer additional heat to the liquid and increase the critical heat flux limit. The motion of liquid and vapor created by the one or more diverters may increase the critical heat flux limit by allowing removal of vapor and access of liquid to regions previously occupied by vapor.

A pool boiling apparatus includes a housing with a chamber, one or more protruding features in the chamber of the housing, and one or more diverters extending at least partially across the one or more protruding features in the chamber. The chamber of the housing with the one or more protruding features and the one or more diverters is configured to form one or more bubbles as a result of boiling to transfer heat. Additionally, the chamber of the housing is configured to divert one or more of the bubbles as a result of bubble nucleation with the one or more diverters to generate additional localized motion of the liquid along at least one of the one or more protruding features and other surfaces in the chamber of the housing to at least one of transfer additional heat to the liquid and increase the critical heat flux limit. The motion of liquid and vapor created by the one or more diverters can increase the critical heat flux limit by allowing removal of vapor and access of liquid to regions previously occupied by vapor.

This technology provides more efficient and effective methods and apparatuses for at least one of improving heat transfer performance and increase critical heat flux in pool boiling. With this technology, heat can be removed more effectively from heated surfaces than with prior pool boiling systems. Additionally, this technology is superior to prior flow boiling cooling techniques because it does not require an external pumping device or a complicated input and/or exit header design to remove heat from the heat transfer surfaces. Instead, this technology utilizes nucleating bubbles and one or multiple cover element devices to control and divert the localized motion of the bubbles and liquid through the passageways formed by the surface features for effective heat transfer in the region affected by the nucleating bubbles and in a more compact and simpler heat transfer apparatus. The localized motion of liquid and vapor created by the diverters can also improve the critical heat flux limit.

This technology incorporates one or multiple diverters positioned over a chamber and features to divert liquid around one or more nucleating bubbles over the surfaces of the chamber and/or features to provide enhanced heat transfer. With this technology, fresh liquid for additional heat transfer is introduced in the regions or passageways where the diversion occurred with little resistance as a result of the diverted fluid. The diverters are designed to introduce very little resistance to fluid flow in the regions or passageways which helps in bringing the liquid into the regions or passageways especially at high heat fluxes, thereby improving Critical Heat Flux. In addition to facilitating fresh liquid entering the regions or passageways with little resistance, this technology ensures the surfaces of the one or more features and other surfaces in the chamber of the housing do not dry out or remain under dry conditions for extended time, and increase the critical heat flux. The neighboring diverters can be designed to interact with each other in directing liquid and vapor in specific directions to allow for more efficient flow of fluids through the passageways, vapor out of the passageways and liquid into the passageways. The diverters could also be designed to control vapor and liquid motion in all three dimensions by providing different shapes and profiles.

With this technology, the diverted growth and/or motion of one or more bubbles also causes enhanced microconvection over the one or more and other surfaces in the chamber of the housing and/or other features. This enhanced microconvection over the one or more and other surfaces in the chamber of the housing and/or other features leads to enhanced heat transfer. The enhanced microconvection may lead to increase of the heat transfer by other modes of heat transfer during boiling.

DETAILED DESCRIPTION

Figure 1A:
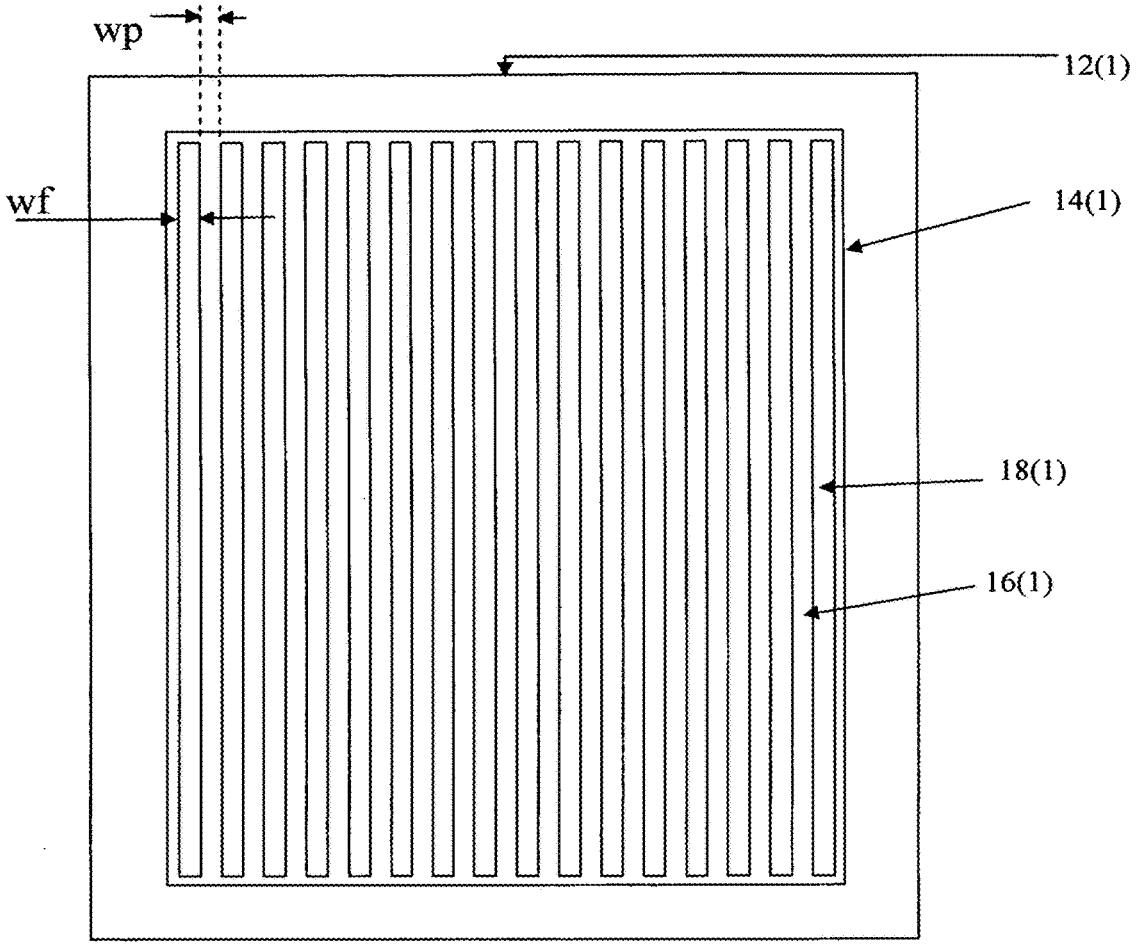
FIG. 1A is a top view of an exemplary pool boiling assembly with diverters and fasteners removed.
Figure 1B:
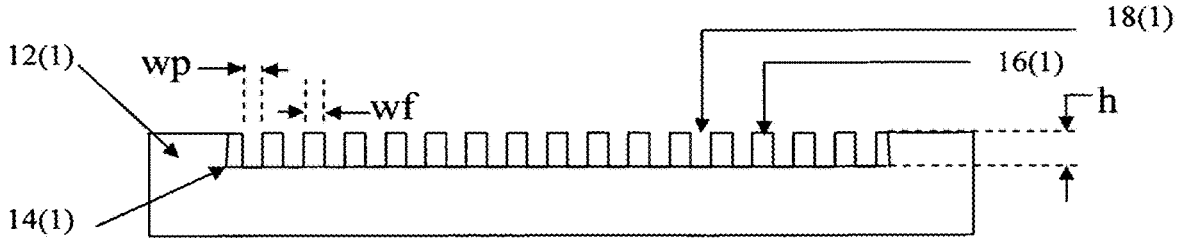
FIG. 1B is a side, cross-sectional view of the exemplary pool boiling assembly shown in FIG. 1A.
Figure 1C:
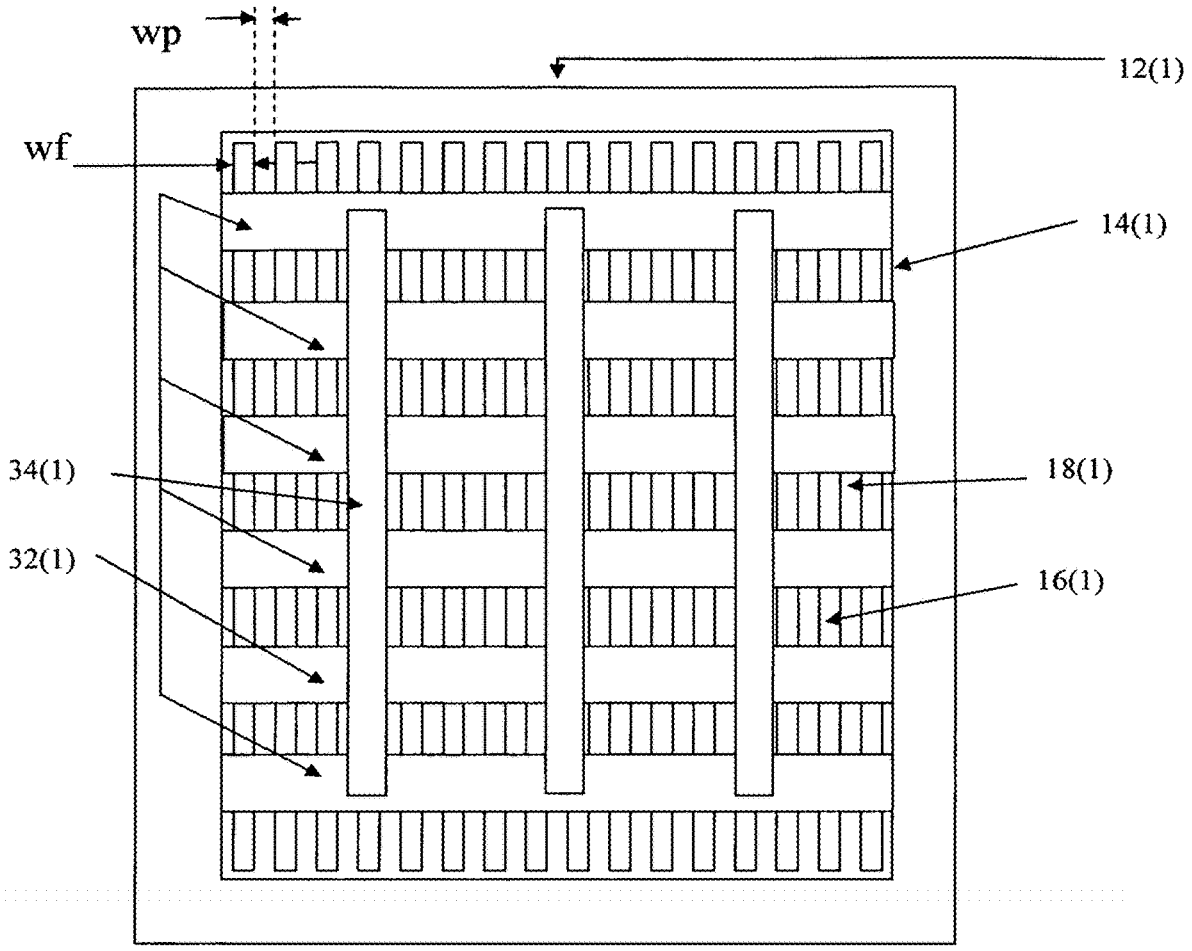
FIG. 1C is a top view of an exemplary pool boiling assembly shown in FIG. 1A with the diverters and fasteners.
Figure 1D:
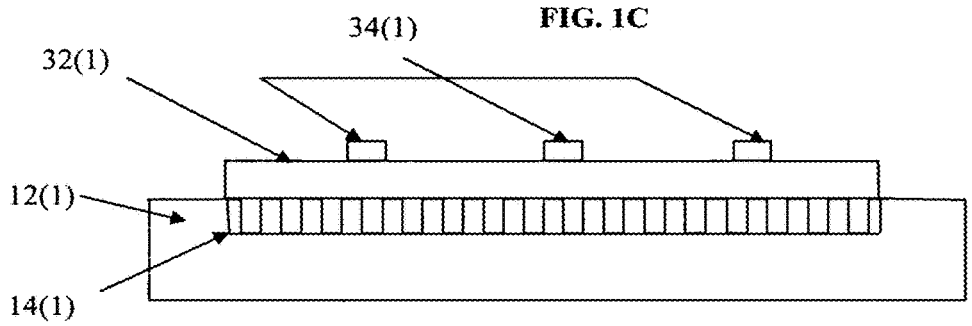
FIG. 1D is a side, cross-sectional view of the exemplary pool boiling assembly shown in FIG. 1C.
Figure 2A:
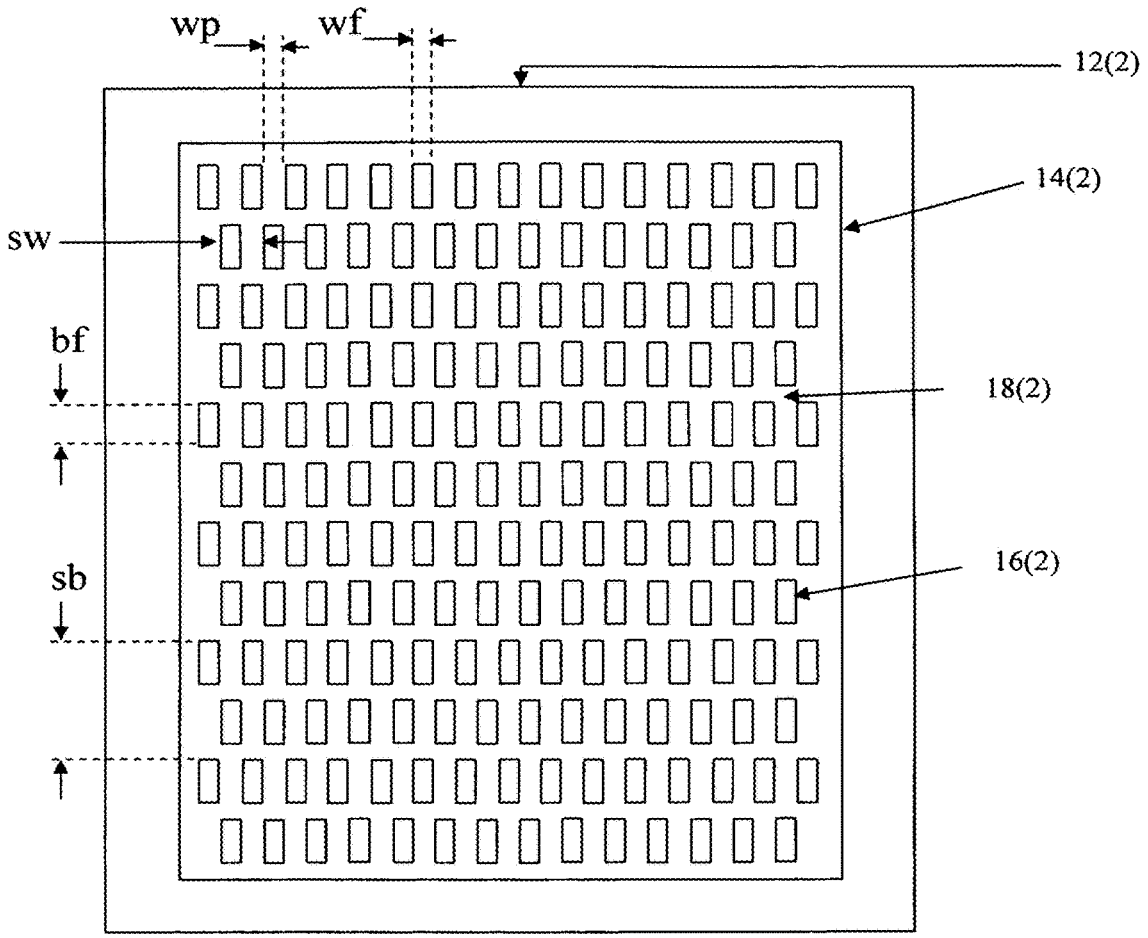
FIG. 2A is a top view of another exemplary pool boiling assembly with diverters and fasteners removed.
Figure 2B:
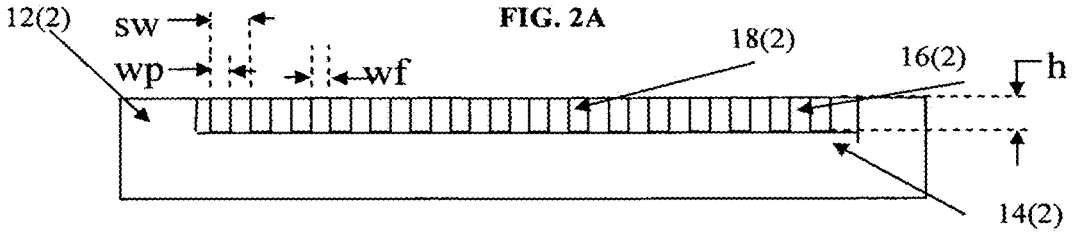
FIG. 2B is a side, cross-sectional view of the exemplary pool boiling assembly shown in FIG. 2A.
Figure 2C:
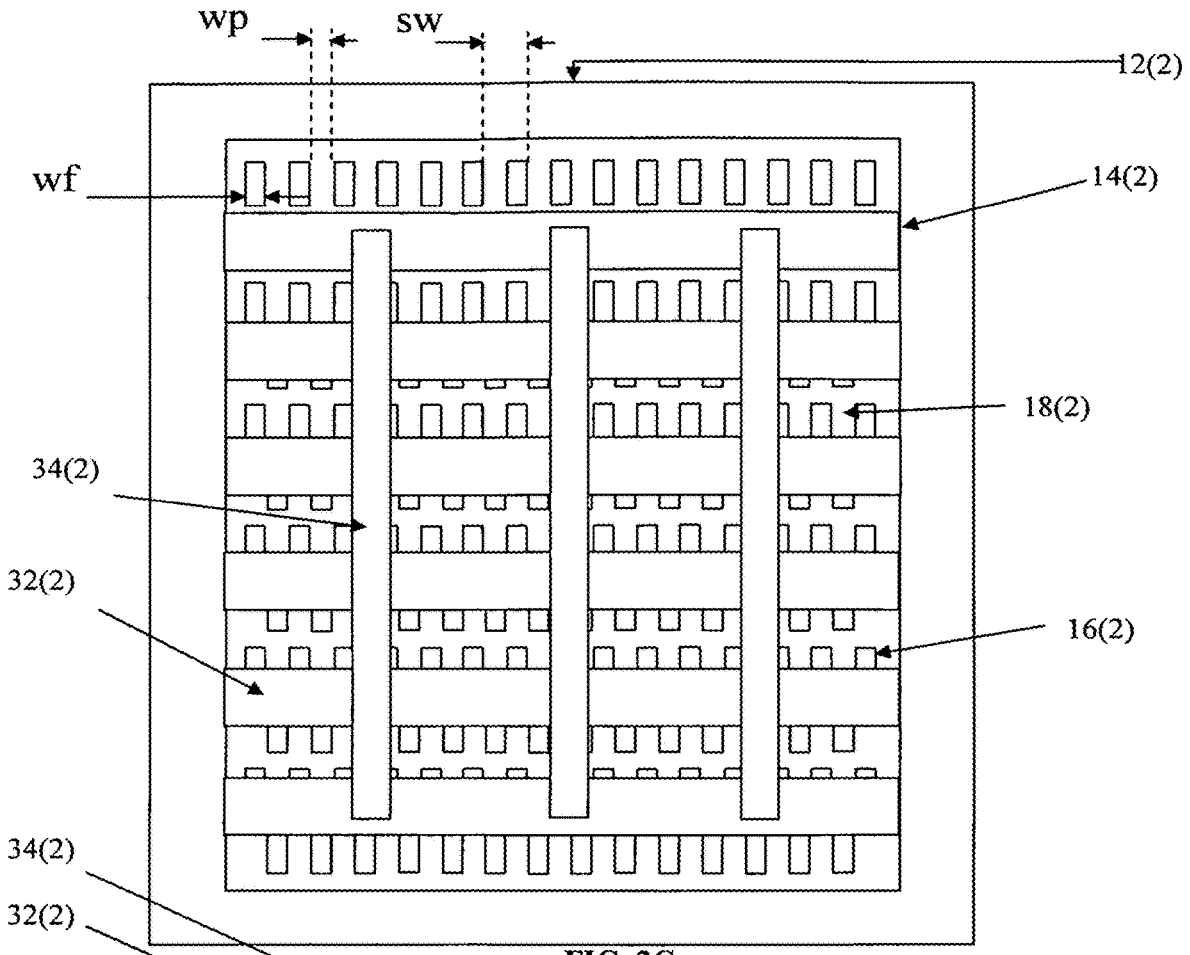
FIG. 2C is a top view of an exemplary pool boiling assembly shown in FIG. 2A with the diverters and fasteners.
Figure 2D:
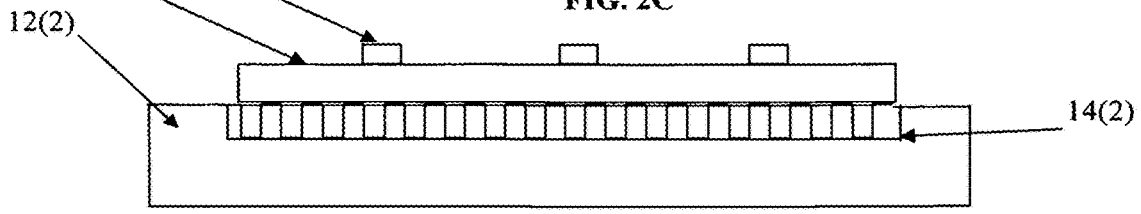
FIG. 2D is a side, cross-sectional view of the exemplary pool boiling assembly shown in FIG. 2C.

An exemplary pool boiling assembly 12(1) is illustrated in FIGS. 1A-1D. The exemplary pool boiling assembly 12(1)

includes a chamber 14(1) which has a plurality of fins 16(1) which define a plurality of regions 18(1) creating passageways to receive a cooling fluid, although the apparatus could comprise other numbers and types of systems, devices, components and other elements in other configurations. This technology provides more efficient and effective methods and apparatuses for at least one of improving heat transfer performance and increase critical heat flux in pool boiling.

Referring more specifically to FIGS. 1A-1D, the exemplary pool boiling assembly 12(1) is illustrated. The pool boiling assembly 12(1) defines an internal chamber 14(1) having a rectangular shape, although the pool boiling assembly can have other numbers and types of chambers or other openings with other shapes.

The plurality of strip fins 16(1) are located in the chamber 14(1) of the pool boiling assembly 12(1), although the chamber of the pool boiling assembly could have other numbers and types of features. (For ease of illustration only one of the plurality of strip fins in FIGS. 1A-1D is shown with a reference numeral). In this example, the plurality of strip fins 16(1) are arranged in an aligned parallel pattern in the chamber 14(1) of the pool boiling assembly 12(1), although the plurality of strip fins could have other arrangements. The plurality of strip fins 16(1) define a plurality of regions 18(1) between the strip fins 16(1) which can receive the cooling liquid or other fluid and where boiling can occur, although the chamber of the pool boiling assembly could have other numbers and types of regions with other shapes and in other directions.

The surfaces of the chamber 14(1) of the pool boiling assembly 12(1) and the plurality of strip fins 16(1) are formed with natural and/or artificial cavities to promote nucleation to start bubble formation, although other manners for promoting bubble formation can be used. The bubbles resulting from this nucleation induce localized movement of a liquid in the chamber 14(1) of the pool boiling assembly 12(1) without an external pumping device, although other manners for promoting pool boiling bubble formation can be used.

Figure 4:
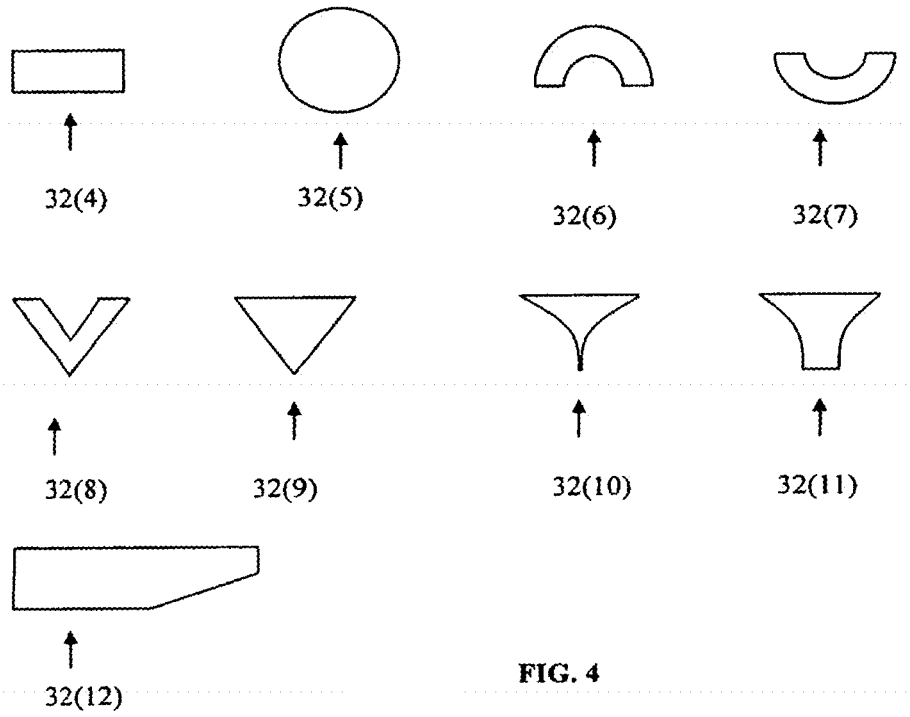
FIG. 4 are side cross-sectional views of different exemplary diverters.

Six diverters 32(1) are spaced apart and extend across the chamber 14(1) of the pool boiling assembly 12(1), although other types and numbers of diverters can be used. Each end of the six diverters 32(1) is secured to the pool boiling assembly 12(1), although other manners for securing the diverters can be used. In this example, each of the diverters 32(1) has a rectangular cross-sectional shape, although the diverters could have other types of shapes and configurations as illustrated with exemplary diverters 32(4)-32(12) in FIG. 4, such as circular, concave, convex, open triangular, closed triangular, angled triangular, asymmetric and funnel shapes by way of example only. Each of the different cross-sectional shapes for the diverters 32(1) can interact with the formed bubbles differently to facilitate a different type of localized motion of the liquid. Additionally, diverters 32(1) with different cross-sectional shapes as well as other types, numbers and combinations of diverters can be used with the pool boiling assembly 12(1) to further enhance localized motion and heat transfer.

Additionally, three optional fasteners 34(1) are spaced apart, extend at least partially across, and are secured to each of the diverters 32(1) to secure the position of each of the diverters, although other types and numbers of fastening mechanisms could be used. Openings to the chamber 14(1) are defined between the diverters 32(1) and fasteners 34(1), although other types of arrangements could be used. Although not illustrated, the pool boiling assembly 12(1) could also have a containment cover spaced from and seated over the chamber 14(1) and the diverters 32(1) and fasteners 34(1) to retain the cooling liquid, in particular the vaporized liquid, in the pool boiling assembly 12(1). Additionally and also not illustrated, the pool boiling assembly 12(1) could include a condensation system to capture, condense and return any vaporized liquid to the regions 18(1) in the chamber 14(1). Additionally and also not illustrated, the pool boiling assembly 12(1) could include a means to circulate the cooling liquid into and out of the volume formed by the containment cover and the chamber 14(1). The loop could include an external heat exchanger to remove heat from the cooling fluid and to condense any vapor that leaves the volume. As discussed earlier, the cooling fluid may be single-phase liquid, gas or a two-phase liquid-vapor mixture, although other types of fluids could be used.

Referring to FIGS. 2A-2D, an example of another pool boiling assembly 12(2) is illustrated. The pool boiling assembly 12(2) defines another internal chamber 14(2) having a rectangular shape, although the housing can have other numbers and types of chambers or other openings with other shapes.

A plurality of strip fins 16(2) are located in the chamber 14(2) of the pool boiling assembly 12(2), although the chamber of the pool boiling assembly could have other numbers and types of features. (For ease of illustration only one of the plurality of strip fins 16(2) in FIGS. 3A-3D is shown with a reference numeral). The plurality of strip fins 16(2) are in an offset arrangement in the chamber 14(2) of the pool boiling assembly 12(2), although the plurality of strip fins could have other arrangements. The plurality of strip fins 16(2) define a plurality of parallel regions 18(2) creating passageways between the strip fins 16(2) which can receive the cooling liquid or other fluid and where boiling can occur, although the chamber of the pool boiling assembly could have other numbers and types of regions with other shapes and in other directions. The pitch and spacing in both directions, shape, width and length of the fins could remain same or vary in the chamber 14(2).

The surfaces of the chamber 14(2) of the pool boiling assembly 12(2) and the plurality of strip fins 16(2) are formed with natural and/or artificial cavities to promote nucleation to start bubble formation, although other manners for promoting bubble formation can be used. The bubbles resulting from this nucleation induce localized movement of a liquid in the chamber 14(2) of the pool boiling assembly 12(2) without an external pumping mechanism, although other manners for promoting bubble formation can be used.

Six diverters 32(2) are spaced apart and extend across the chamber 14(2) of the pool boiling assembly 12(2), although other types and numbers of diverters can be used. Each end of the six diverters 32(2) is secured to the pool boiling assembly 12(2), although other manners for securing the diverters can be used. In this example, each of the diverters 32(2) has a rectangular cross-sectional shape, although the diverters could have other types of shapes and configurations as illustrated with exemplary diverters 32(4)-32(12) in FIG. 4, such as circular, concave, convex, open triangular, closed triangular, angled triangular, asymmetric and funnel shapes by way of example only. Each of the different cross-sectional shapes for the diverters 32(2) can interact with the formed bubbles differently to facilitate a different type of localized motion of the liquid in the passageways. Additionally, diverters 32(2) with different cross-sectional shapes can be used with the pool boiling assembly 12(2) to further enhance localized motion and heat transfer.

Additionally, three optional fasteners 34(2) are spaced apart, extend at least partially across, and are secured to each of the diverters 32(2) to secure the position of each of the diverters, although other types and numbers of fastening mechanisms could be used. Openings to the chamber 14(2) are defined between the diverters 32(2) and fasteners 34(2), although other types of arrangements could be used. Although not illustrated, the pool boiling assembly 12(2) could also have a containment cover spaced from and seated over the chamber 14(2) and the diverters 32(2) and fasteners 34(2) to retain the cooling liquid, in particular the vaporized liquid, in the pool boiling assembly 12(2). Additionally and also not illustrated, the pool boiling assembly 12(2) could include a condensation system to capture, condense and return any vaporized liquid to the regions 18(2) in the chamber 14(2). Additionally and also not illustrated, the pool boiling assembly 12(2) could include a means to circulate the cooling liquid into and out of the volume formed by the containment cover and the chamber 14(2). The loop could include an external heat exchanger to remove heat from the cooling fluid and to condense any vapor that leaves the volume.

Referring to FIGS. 3A-3D, an example of yet another pool boiling assembly 12(3) is illustrated. The pool boiling assembly 12(3) defines another internal chamber 14(3) having a rectangular shape, although the housing can have other numbers and types of chambers or other openings with other shapes.

Figure 3A:
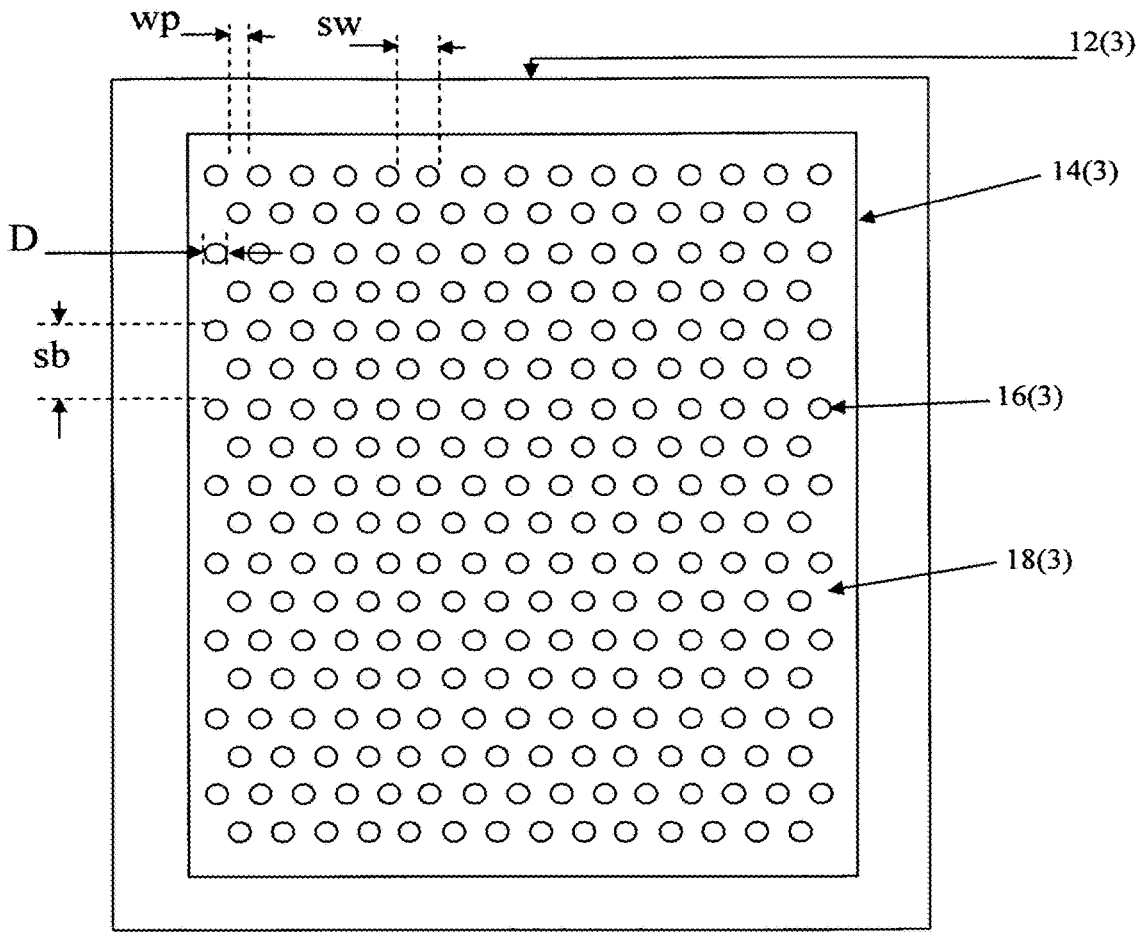
FIG. 3A is a top view of yet another exemplary pool boiling assembly with diverters and fasteners removed.
Figure 3B:
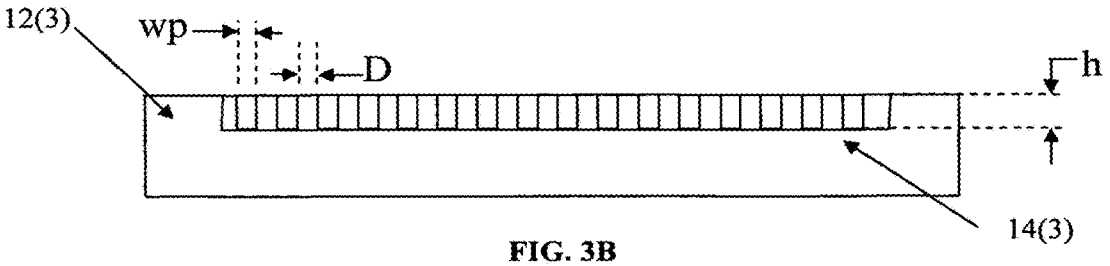
FIG. 3B is a side, cross-sectional view of the exemplary pool boiling assembly shown in FIG. 3A.
Figure 3C:
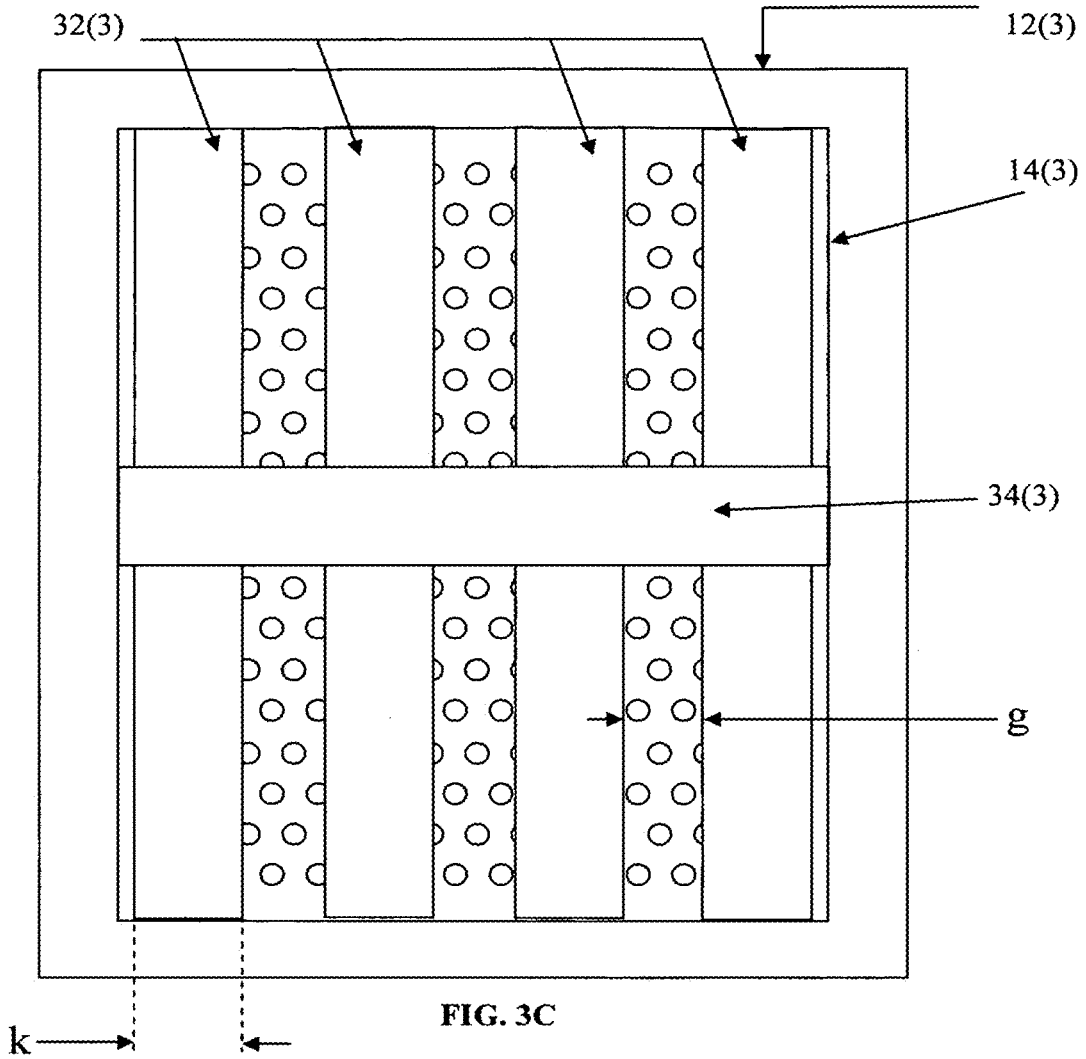
FIG. 3C is a top view of an exemplary pool boiling assembly shown in FIG. 3A with the diverters and fasteners.
Figure 3D:
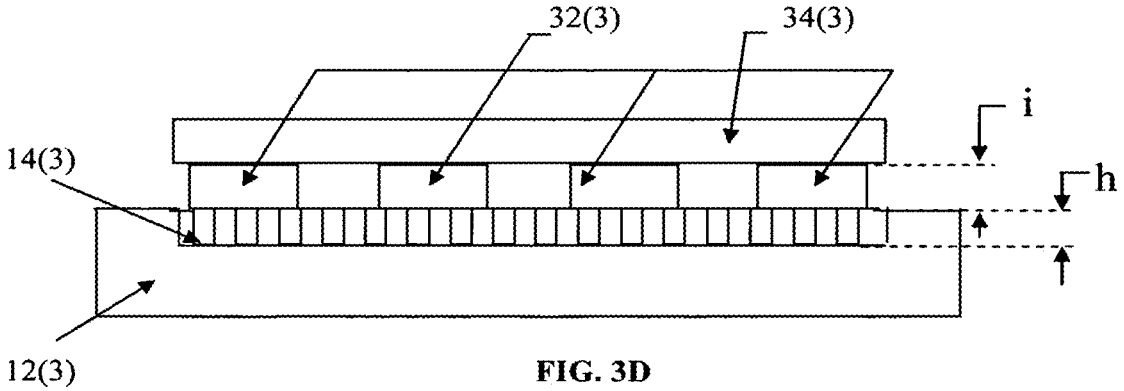
FIG. 3D is a side, cross-sectional view of the exemplary pool boiling assembly shown in FIG. 3C.

A plurality of pins 16(3) are located in the chamber 14(3) of the pool boiling assembly 12(3), although the chamber of the pool boiling assembly could have other numbers and types of features. The fin shown is circular in cross section, although fins could be of any constant or variable cross sections. (For ease of illustration only one of the plurality of pins in FIG. 3A is shown with a reference numeral). The plurality of pins 16(3) are in an offset arrangement in the chamber 14(3) of the pool boiling assembly 12(3), although the plurality of pins 16(3) could have other arrangements. The plurality of pins 16(3) define a plurality of regions 18(3) creating passageways between the pins 16(3) which can receive the cooling liquid or other fluid and where boiling can occur, although the chamber 14(3) of the pool boiling assembly 12(3) could have other numbers and types of regions with other shapes and in other directions.

The surfaces of the chamber 14(3) of the pool boiling assembly 12(3) and the plurality of pins 16(3) are formed with natural and/or artificial cavities to promote nucleation to start bubble formation, although other manners for promoting bubble formation can be used. The bubbles resulting from this nucleation induce localized movement of a liquid in the chamber 14(3) of the pool boiling assembly 12(3) without an external pumping device, although other manners for promoting pool boiling bubble formation can be used.

Four diverters 32(3) are spaced apart and extend across the chamber 14(3) of the pool boiling assembly 12(3), although other types and numbers of diverters can be used. Each end of the four diverters 32(3) is secured to the pool boiling assembly 12(3), although other manners for securing the diverters can be used. In this example, each of the diverters 32(3) has a rectangular cross-sectional shape, although the diverters could have other types of shapes and configurations as illustrated with exemplary diverters 32(4)-32(12) in FIG. 4, such as circular, concave, convex, open triangular, closed triangular, angled triangular, asymmetric and funnel shapes by way of example only. Each of the different cross-sectional shapes for the diverters 32(3) can interact with the formed bubbles differently to facilitate a different type of localized motion of the liquid. Additionally, diverters 32(3) with different cross-sectional shapes can be used with the pool boiling assembly 12(3) to further enhance localized motion and heat transfer.

Additionally, one optional fastener 34(3) extends at least partially across and is secured to each of the diverters 32(3) to secure the position of each of the diverters 32(3), although other types and numbers of fastening mechanisms could be used. Openings to the chamber 14(3) are defined between the diverters 32(3) and fastener 34(3), although other types of arrangements could be used. Although not illustrated, the pool boiling assembly 12(3) could also have a containment cover spaced from and seated over the chamber 14(3) and the diverters 32(3) and fastener 34(3) to retain the cooling liquid, in particular the vaporized liquid, in the pool boiling assembly 12(3). Additionally and also not illustrated, the pool boiling assembly 12(3) could include a condensation system to capture, condense and return any vaporized liquid to the regions 18(3) in the chamber 14(3). Additionally and also not illustrated, the pool boiling assembly 12(2) could include a means to circulate the cooling liquid into and out of the volume formed by the containment cover and the chamber 14(2). The loop could include an external heat exchanger to remove heat from the cooling fluid and to condense any vapor that leaves the volume.

A method for transferring heat with pool boiling assembly 12(1) will now be described with reference to FIG. 1 and FIGS. 5A-5C. For ease of illustration, the plurality of strip fins 16(1) are not illustrated in the side cross-sectional views of FIGS. 5A-5C. The method for transferring heat with the heat transfer assemblies 12(2)-12(3) is the same as for pool boiling assembly 12(1), except as illustrated and/or described herein.

A liquid or liquid vapor mixture is initially introduced into regions 18(1) of the chamber 14(1) of the pool boiling assembly 12(1). The liquid contacts surfaces of the plurality of strip fins 16(1) and other surfaces of the chamber 14(1) to transfer heat from the pool boiling assembly 12(1). At least portions of the surfaces of the plurality of strip fins 16(1) and/or the chamber 14(1) of the pool boiling assembly 12(1) are formed with natural and/or artificial cavities to promote nucleation. The heated surfaces of the chamber 14(1) and/or plurality of strip fins 16(1) along with the cavities trigger nucleation to start the formation of bubbles to induce localized movement of the liquid in the chamber 14(1) of the pool boiling assembly 12(1).

For example, as the introduced liquid engages with natural and/or artificial cavities in a heated surface of the pool boiling assembly 12(1) and/or the plurality of strip fins nucleation may be triggered. When nucleation is triggered, one or more bubbles, such as a bubble B shown in FIG. 5A, may be formed, although other manners for forming bubbles could be used.

Figure 5A:
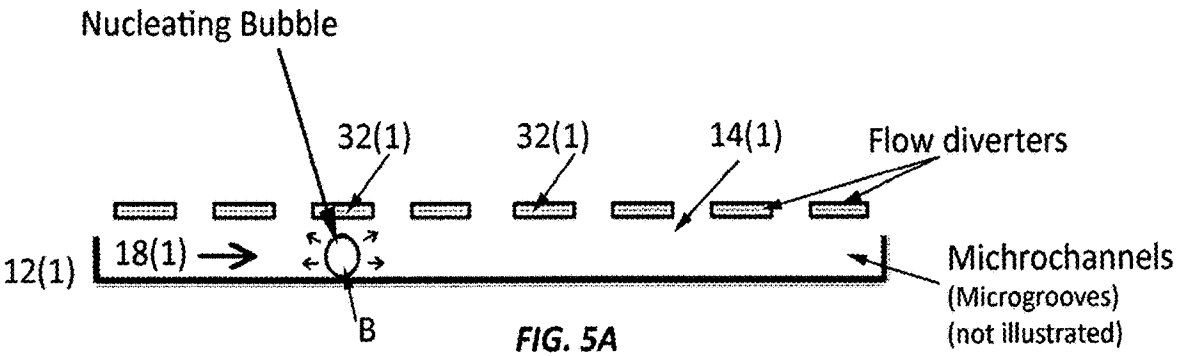
FIGS. 5A-5C are partial, side cross-sectional views of fluid flow induced by bubble growth in an exemplary pool boiling assembly.
Figure 5B:
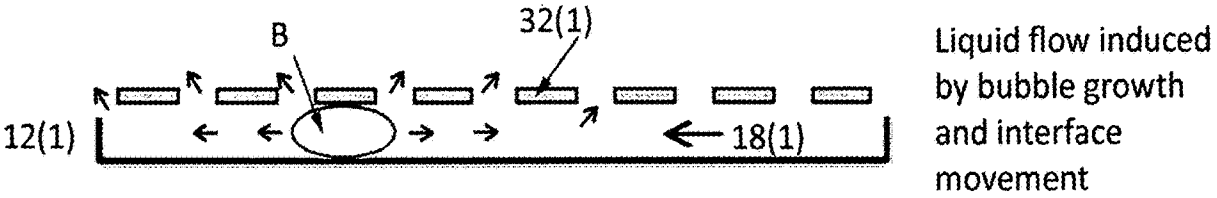

As the bubble B grows as shown in FIG. 5B, liquid in the regions 18(1) is induced to move locally in one or multiple directions without an external pumping mechanism. This localized movement of the liquid causes more interaction and heat transfer between the liquid and surfaces of the pool boiling assembly 12(1) and/or the plurality of strip fins 16(1). In this example, heat transfer from this boiling occurs as a result of microconvection, transient conduction, and microlayer evaporation.

Figure 5C:
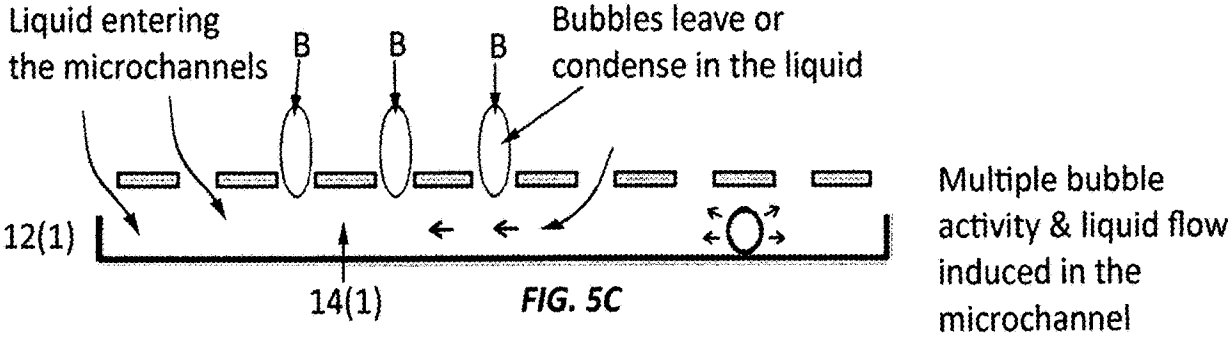

As shown in FIG. 5C, as the bubble B engages with one or more of the diverters 32(1) which diverts the vapor bubble to grow and/or travel in certain directions. The bubble may escape from the opening in the diverter or may break the initial bubble B into three new bubbles B that leave the passageways and induce liquid movement in the passageways and further induce fresh liquid to enter the passageways, although other manners for generating other numbers of bubbles and liquid movement within the passageways could be used. Additionally, the diverters may redirect the growth and path of the bubbles without breaking the bubbles. In this example, the diverters 32(1) have a rectangular cross-sectional shape, although the diverters 32(1) could have other cross-sectional shapes that provide further enhancement to the heat transfer. The movement of the original bubble and generation of these three new bubbles B by 30 the diverters 32(1) creates additional localized motion of the liquid. This additional localized movement of the liquid causes additional interaction and further enhanced heat transfer between the liquid and surfaces of the pool boiling assembly 12(1) and/or the plurality of strip fins 16(1) without the need for an external pumping device or complicated header design. In this example, the additional heat transfer occurs as a result of microconvection, transient conduction, and microlayer evaporation.

Another method for transferring heat with pool boiling assembly 12(1) with asymmetric diverters 32(12) will now be described with reference to FIG. 1, 4 and FIGS. 6A-6B. For ease of illustration, the plurality of strip fins 16(1) are not illustrated in the side cross-sectional views of FIGS. 6A-6B. This exemplary method for transferring heat with pool boiling assembly 12(1) with diverters 32(12) is the same as described earlier with reference to FIGS. 6A-6B, except as illustrated and described herein. Additionally, this exemplary method for pool boiling assembly 12(1) is the same for the heat transfer assemblies 12(2)-12(3), except as illustrated and/or described herein.

Figure 6A:
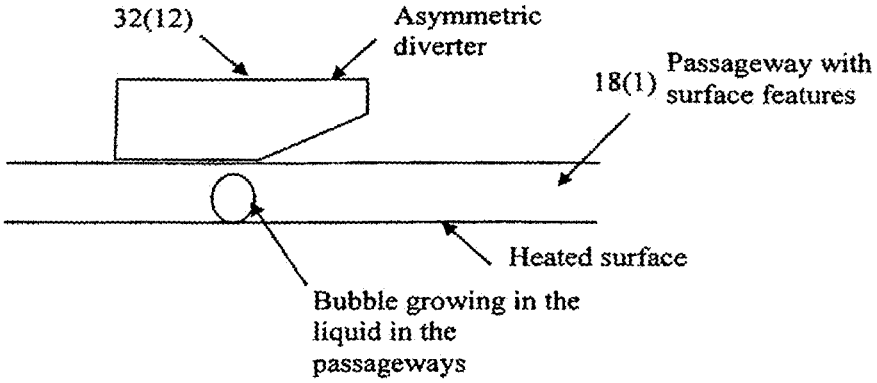
FIGS. 6A-6B are partial, side cross-sectional views of fluid flow induced by bubble growth in another exemplary pool boiling assembly with asymmetric diverters.
Figure 6B:
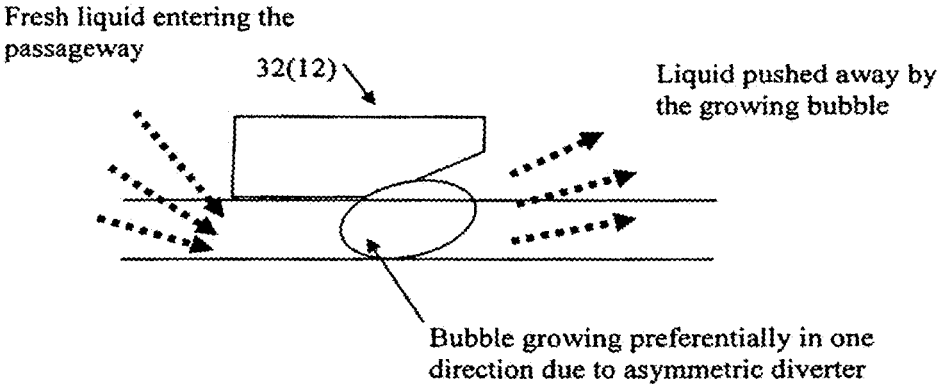

When nucleation is triggered, one or more bubbles as shown in FIG. 6A, may be formed, although other manners for forming bubbles could be used. As the bubble B grows as shown in FIG. 6B, liquid in the regions 18(1) is pushed out of the passageway and fresh liquid is drawn in with little resistance without an external pumping mechanism. The shape and positioning of the asymmetric diverter 32(12) enhances and controls the direction of the diversion of bubble growth providing further enhancement and control of heat transfer in the pool boiling assembly 12(1), although other types, numbers and combinations of diverters could be used to generate and control other types of localized flows. Accordingly, with this technology heat transfer can be optimized by the particular selection of geometry and configurations of diverters and surface features for a given fluid and operating conditions.

As described earlier, this localized movement of the liquid causes more interaction and heat transfer between the liquid and surfaces of the pool boiling assembly 12(1) and/or the plurality of strip fins 16(1). In this example, heat transfer from this boiling occurs as a result of microconvection, transient conduction, and microlayer evaporation.

Accordingly, as illustrated and described with reference to the examples herein, this technology provides a more efficient and effective method and apparatus for transferring heat with pool boiling from a heated surface to an introduced fluid. With this technology, heat can be removed more effectively from heated surfaces than with prior pool boiling systems. Additionally, this technology is superior to prior flow boiling cooling techniques because it does not require an external fluid pumping device or complicated fluid input header designs. Instead, this technology utilizes nucleating bubbles and one or multiple cover element devices to control and divert the localized motion of the bubbles, liquid-vapor interfaces and liquid through the passageways for effective heat transfer and in a more compact and simpler heat transfer apparatus. The efficient movement of vapor and liquid allows for dissipating larger heat fluxes and enhances the heat transfer rate for a given wall superheat and also increases the critical heat flux as compared to prior pool boiling and flow boiling systems.

The disclosure describes a heat transfer enhancement technique in pool boiling wherein a liquid boils on a heated surface. In an embodiment, a manifold block with taper is used on the heater surface to create a tapered microgap in which the nucleated bubbles expand and create a flow of liquid from the bulk into the microgap, and removal of the liquid and vapor from the microgap into the bulk. This arrangement can be used in a number of pool boiling applications such as vapor chambers, thermosiphon loops, reboilers, and electronic chip coolers.

A manifold block is placed on a heater substrate by creating a small gap between the heater substrate and the manifold block. The heater substrate is a plain surface. It may be an enhanced surface with different types of protruding features. This gap is referred to here as the microgap. When a manifold block is placed on the heat transfer plain surface, the microgap is measured as the distance between the plain surface and the manifold block, and in the case of an enhanced surface, the microgap is measured as the distance between the top of the protruding feature and the manifold block, at a given cross section. When the manifold block is placed over a heater substrate in a pool boiling system, liquid occupies this microgap and bubbles are formed on the heater substrate in the microgap. A taper is introduced in the manifold block surface facing the heater substrate, thereby creating an increasing cross-sectional area of the microgap in the direction of the increasing taper. The two sides of the microgap at the beginning and end sections are in fluid communication with the bulk liquid. The bubbles nucleating over the heater substrate in the tapered microgap region grow and expand in a preferential direction towards the increasing cross-sectional area of the microgap due to the taper. A tapered manifold performs as and can be considered a bubble diverter.

The bubbles growing and expanding in the tapered microgap push the liquid and vapor in front of the bubble out of the microgap into the bulk liquid. The bubble also travels in the same direction of the increasing taper and causes liquid behind it to flow in the same direction. The liquid from the bulk is sucked into the microgap region following the bubble moving in the direction of the increasing taper.

The substrate can be a plain surface or a surface with any protruding features, including but not limited to, roughness, fins, microchannels, porous coating, features with different surface energies, etc.

The bubble movement in the increasing flow cross-sectional area direction of the microgap causes removal of the vapor and liquid from the microgap region and liquid resupply from the bulk in the microgap over the heated substrate. The continuous effective vapor removal and surface rewetting leads to enhanced heat transfer in pool boiling.

The width of the microgap introduces three-dimensional effects. The expanding bubbles may tend to grow laterally in the direction normal to the taper to some extent. However, the overall effect of the expanding bubble is to create a liquid and liquid plus vapor flow in the increasing taper direction in the microgap. To improve the bubble pumping action in one of the embodiments, whereas the liquid enters the inlet section and liquid and vapor exit the outlet sections, the other remaining faces of the microgap may be open for fluid communication of the fluid in the microgap with the bulk liquid or may be closed to direct the flow in the microgap from the inlet section to outlet section. The features to provide this closing feature may be incorporated in the manifold or on the heater surface.

For larger heater substrates, two adjacent tapered manifolds may be combined to provide a single liquid inlet port to the microgap region from the bulk liquid. This configuration is referred as dual taper. Similarly, two adjacent tapered manifolds may be combined to provide a single liquid and vapor outlet port from the microgap towards the bulk liquid. The pool boiling system can include single taper, dual taper, or multiple dual tapers, suitably combined to facilitate efficient liquid inlet to the tapered microgap region and efficient liquid and vapor removal from the microgap region based on the size, performance or other system considerations.

The expanding bubble in the increasing taper direction provides a force, called here as the expansion force, that is used in overcoming the flow resistance, which is the frictional resistance and the inertia of the flow of both liquid and vapor, in the microgap. The microgap height and the taper angle where the bubble is nucleated influence the magnitude of the expansion force. For this force to be effective, the microgap has to be small enough to contain the bubble and provide the squeezing action in the desired flow direction, which is in the same direction as the increasing taper. At the beginning of the taper, the initial microgap height should be small enough to provide this squeezing action. The growth rate of the bubble depends on the heat flux employed. The functioning of the microgap thus becomes more efficient in terms of expansion force as the heat flux increases. This provides a mechanism which is able to facilitate heat dissipation as the heat flux increases. The region where bubble squeezing action occurs is where the expansion force is experienced. As the microgap height increases in the taper direction, at some point, the bubbles may depart from the heater surface and flow in the microgap without providing the squeezing action. The increasing area will provide pressure recovery effect; the squeezing effect provides further force to move the bubble interface and the fluid in the desired flow direction. It is desirable to provide the outlet port close to this location since no significant expansion force will be generated while the bubble is flowing freely in the microgap, although it might still be expanding due to evaporation from the bubble interface. Effectively the expansion force will be reduced as the microgap height increases beyond a certain limit depending on the bubble size. A certain additional length of the microgap may be present beyond the point where the squeezing action is not effective in generating the expansion force since the expansion force generated in the earlier region where squeezing was effective may be able to overcome the additional flow resistance.

Figure 7:
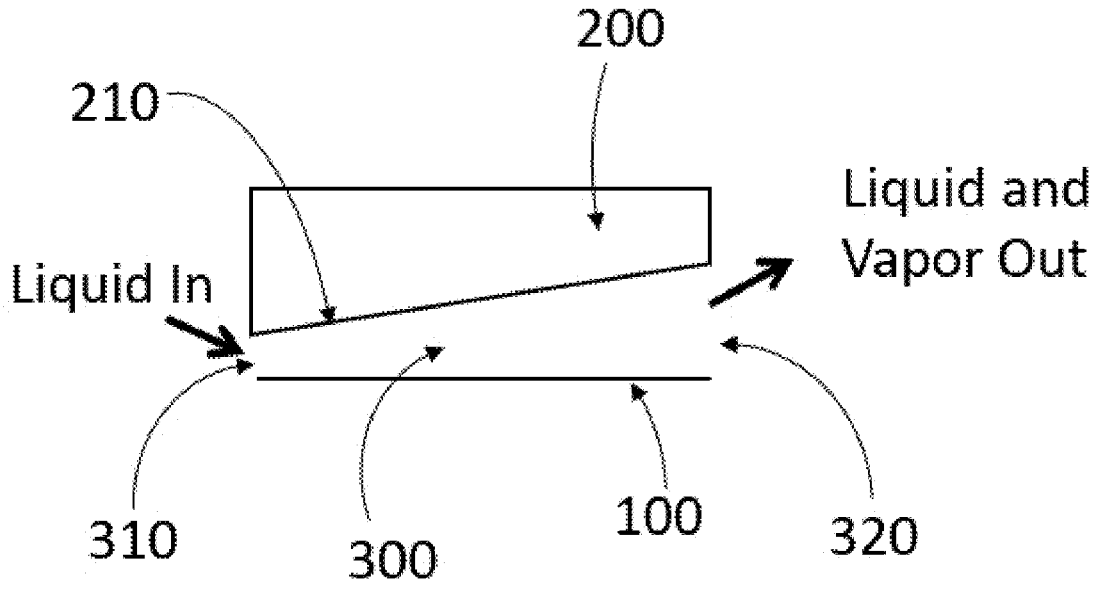
FIG. 7 is a schematic of the tapered manifold secured over a heating substrate.

FIG. 7 shows a schematic of an exemplary tapered manifold design. A manifold block 200 is placed over the heater substrate 100. The tapered surface 210 and the heater substrate 100 create a microgap 300. Liquid enters the inlet microgap section 310 and liquid and vapor leave the exit microgap section 320. During pool boiling, bubbles are formed in the liquid on the heater substrate 100.

Figure 8:
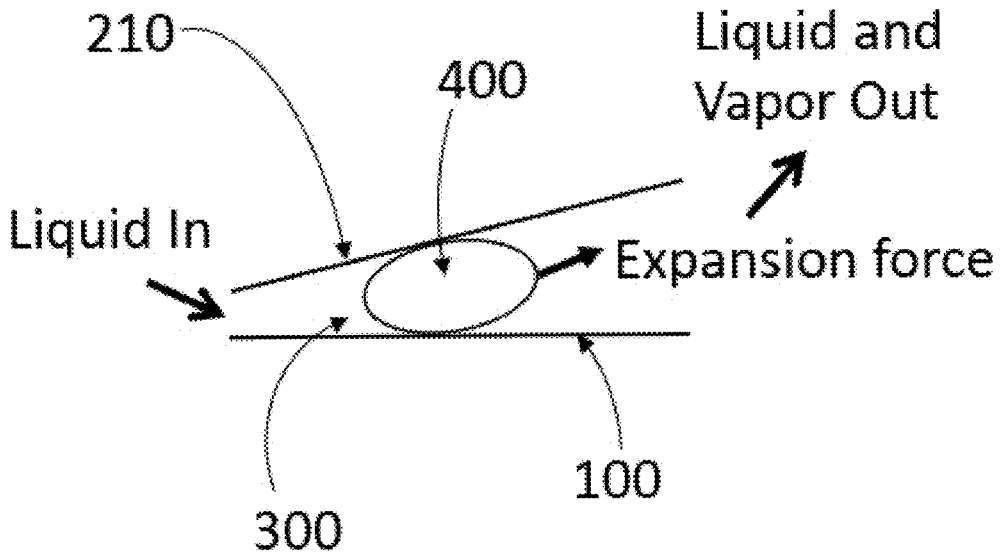
FIG. 8 is a schematic of the expanding bubble in the microgap applying expansion force pushing the liquid and vapor out and sucking liquid in from the bulk.

FIG. 8 shows an expanding bubble 400 in the microgap 300. The bubble has been formed from nucleation on the heater surface and has grown to occupy the entire height of the microgap as shown. The bubble expands due to evaporation and creates an expansion force in the increasing taper direction. The expansion force causes the bubble interface and the bubble to move towards the exit and results in a flow of liquid through the inlet section and flow of liquid and vapor out of the exit section. The expansion force is a function of heat flux, fluid properties and microgap height. The expansion force overcomes the flow resistance due to liquid flow and flow of liquid and vapor in the microgap. These forces and flow resistances can be calculated from available equations in literature.

Figure 9A:
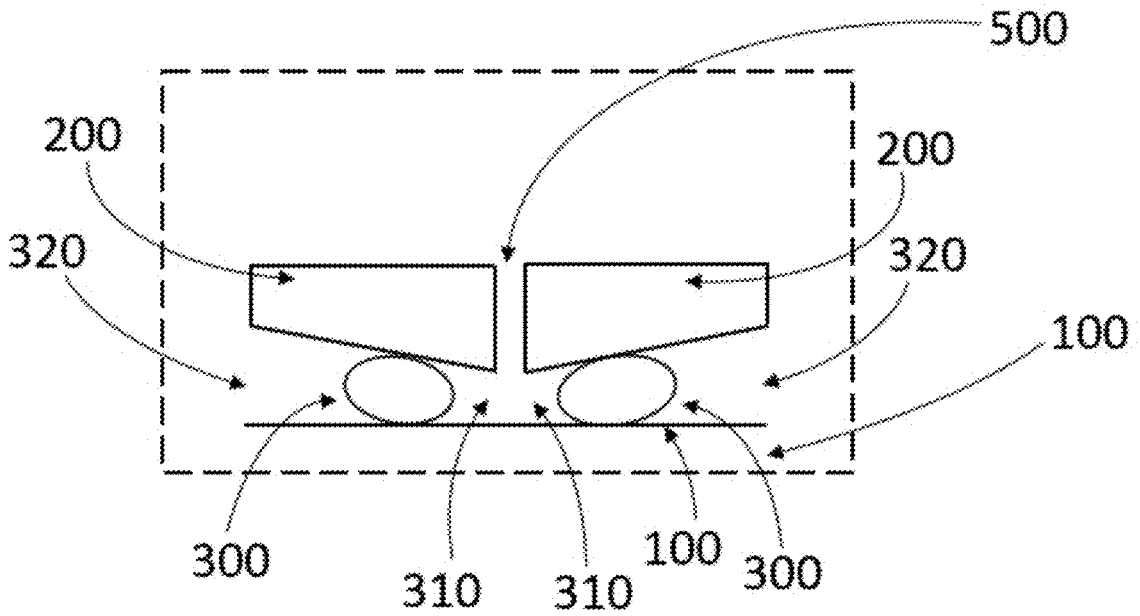
FIG. 9A is a schematic of a single inlet port with two outlet sections and FIG. 9B show two inlet sections with single outlet port.
Figure 9B:
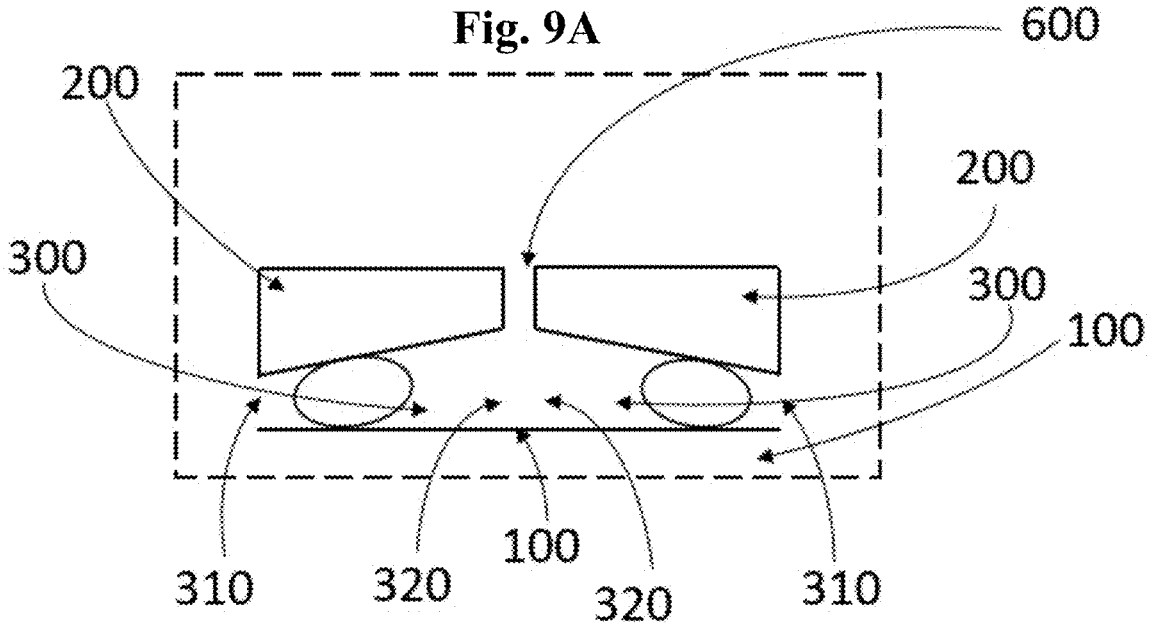

FIG. 9A and FIG. 9B show two of the possible arrangements of placing the two tapered manifolds adjacent to each other. FIG. 9A shows a single inlet port 500 serving two adjacent tapered manifolds 200. Liquid enters 500 and flows through the two adjacent inlet sections 310 of the two adjacent microgaps. Liquid and vapor exit the two microgaps 300 and leave through the two outlet sections 320. FIG. 9B shows a single outlet port 600 serving two adjacent tapered manifolds 200. Multiples of the two configurations shown in FIG. 9A and FIG. 9B may be placed adjacent to each other to provide common inlet and exit ports for different manifolds covering a wide region of the heater substrate. The end manifold in the multiple manifold arrangements may individually have either inlet or exit sections at the end communicating with the bulk liquid.

The height of the microgap in the inlet section, the height of the microgap in the outlet section and the manifold taper angle are important considerations. They together also define the length of the microgap in the flow direction. Since the squeezing action of the bubbles provides a pumping action, it is possible to include a certain length of constant microgap height near the inlet section before introducing the taper. Similarly, it is possible to incorporate a constant microgap height before the outlet section. Similarly a constant height section may be incorporated after the inlet section. The flow rates would be reduced in these cases due to increased flow resistance, but may still be enough to provide the desired heat transfer enhancement. The constant height may be replaced by a varying height at a different taper angle and the expansion force will change accordingly in this region and provide different level of pumping action. The inlet and outlet sections and the inlet and outlet ports may be further contoured to reduce the flow resistance.

The tapered surface of the manifold may have any profile such as curved, stepped, multiple tapers, multiple profiles or any other configuration.

The liquid is pumped into the microgap region due to bubble expansion, thus effectively transforming the pool boiling system into a configuration similar to a local passive flow boiling system but without using any external pump. The motion of liquid and the vapor thus created by the expanding bubbles enhances at least one of the critical heat flux and the heat transfer coefficient.

The tapered manifold configurations can be designed to accommodate different heater sizes and shapes. For heaters that are wider than the manifold length desired to provide certain level of pumping at a desired heat flux, multiple manifold blocks may be employed.

The width of the microgap is also an important consideration. A single width microgap covers the entire heater in one embodiment. To reduce the lateral effects of bubble growth and flow escaping from the sides, separators may be introduced in the microgap that limit the width of each microgap section. The separators may be built in the manifold or may be provided separately by the extensions on the heater substrate or an additional fixture. By avoiding fluid communication between two adjacent microgap sections separated by a separator, the fluid flow stability over the evaporator surface is improved. This arrangement avoids local fluid circulation or stagnant regions and stabilizing the flow and improving the heat transfer performance.

The heater surface may be flat or curved. The heater surface orientation may be different from the horizontal. The flow direction in the microgap may be unidirectional, curved or multidirectional. This technique may be applied on an external tubular surface with taper either in the longitudinal, axial or any other direction. It may be applied to the inside surface of a tube as well.

Multiple manifold blocks may be placed adjacent to each other such that the inlets or outlets of the adjacent manifold covers could be merged allowing scaling of the evaporator with multiple tapered microgaps. The width of the microgap can vary from 200 micrometers to the entire width of the heater. A preferred range for the width is from 1 mm to 20 mm. Another preferred range is from 5 mm to 100 mm. Even larger widths may be used. The width of the inlet and outlet sections may be different and may vary from 200 microns to 100 mm. The flow separators, running along the flow direction and covering partial or the entire length of the microgap, may be incorporated at widths of 100 microns to 50 mm. Multiple separators may be placed in the microgap. Microgaps may be placed, along with their manifolds, adjacent to each other laterally so that they cover additional width of the heater surface. Any combination of individual microgap, manifold and separator arrangement is covered here to provide at least one of the flow stability, heat transfer enhancement, and operational considerations to make the system work properly to provide the desired heat transfer performance. Multiple manifolds in different arrangements may be incorporated to cause the desired effect of removing the bubbles and introducing liquid so as to enhance the heat transfer performance through increasing at least one of the critical heat flux or heat transfer coefficient.

Figure 10:
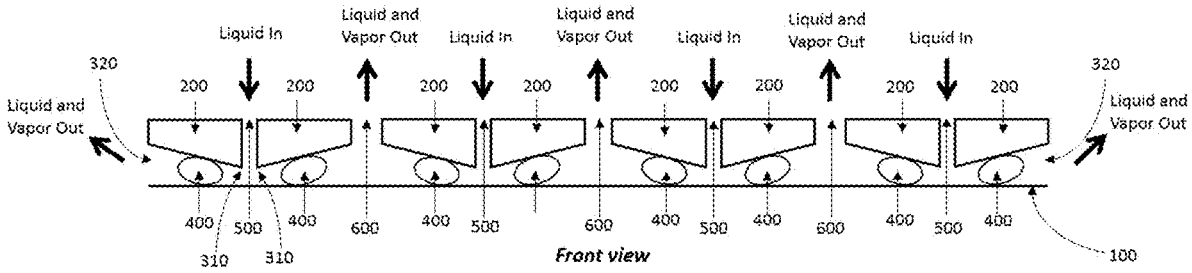
FIG. 10 shows multiple dual tapers are placed next to each other with multiple single inlet and outlet ports.

FIG. 10 shows four sets of dual tapered manifold blocks 200 placed adjacent to each other with multiple inlet 500 and outlet 600 ports arranged alternatively. Both ends of the system have exit sections 320. The manifolds can be arranged to have one inlet section 310 and one outlet section 320 as the end sections, or both ends with same section 310 or 320 to communicate with the bulk liquid. More number of dual or single tapers can be added on the ends in a similar fashion depending on the heated substrate size. Such embodiment is useful for large heater substrates.

Figure 11A:
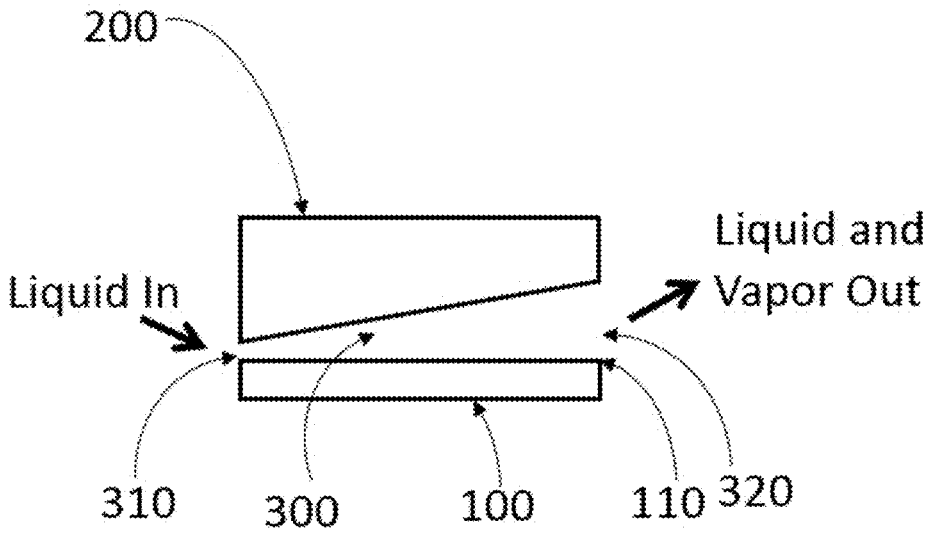
FIG. 11A is a schematic of a heater substrate with microchannels and a FIG. 11B is a heater substrate with fins.
Figure 11B:
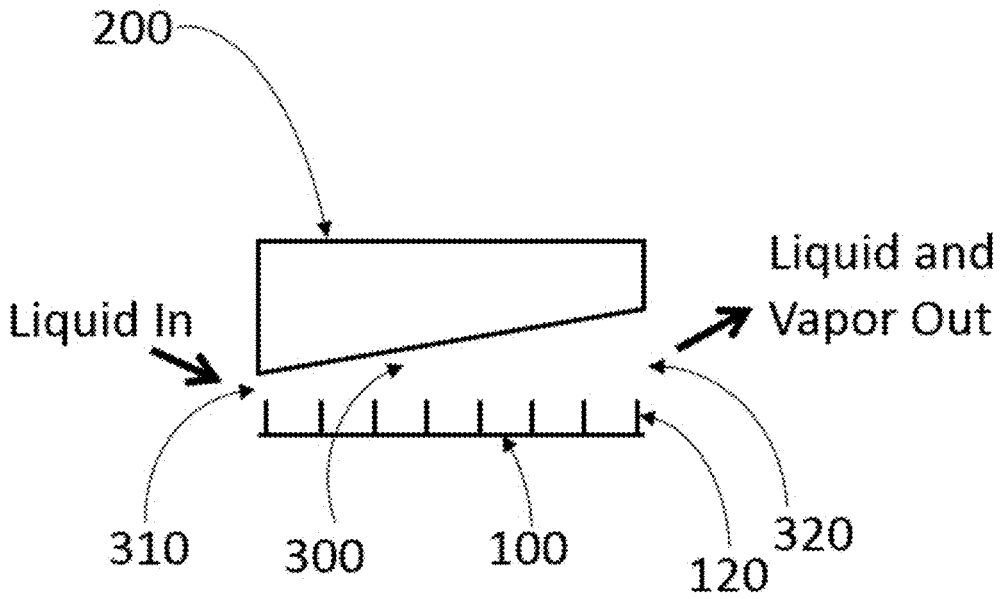
Figure 12A:
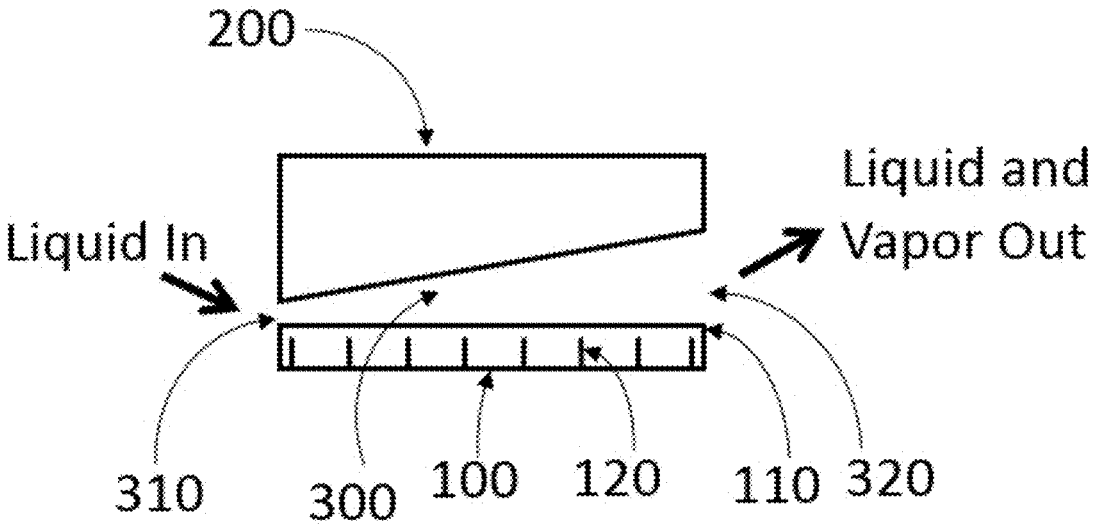
FIG. 12A is a schematic of protruding feature showing the front view of the system with fins in the microchannels and FIG. 12B shows the side view of fins in the microchannels.
Figure 12B:
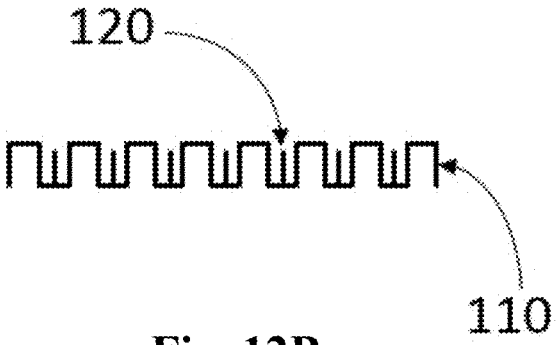

The heater surface may be plain or an enhanced structure with different protruding features. It may consist of microchannels 110 aligned along the flow direction of the fluid as shown in FIG. 11A, typically about 1 micron to 10 mm in depth. The preferred depths may be 20 micrometers to 2 mm. Further preferred range may include 50 micrometers to 500 micrometers. The depth may be constant or variable along the length of the microchannels. The width of the microchannels may vary from 10 micrometers to 1 cm or larger. The microchannels may be replaced with offset strip fin configuration 120 or any other fin configuration as shown in FIG. 11B. The microgap is measured from the top of the protruding feature. The fins height may vary from 5 micrometers to 10 mm, is preferred from 20 micrometers to 1 mm. FIG. 12A and FIG. 12B show another embodiment consisting pin fins 120 in the microchannels 110. The pin fins may be arranged in staggered, offset, in-line, or any other configuration in the microchannels or in the heater substrate. It may also consist of other forms of the structure that are available for enhancing boiling heat transfer, including, but not limited to, porous structures, combinations of microchannels and porous structures, combinations of microstructures and porous structures, combinations of hydrophobic and hydrophilic regions, artificial cavities, other boiling heat transfer features, and combinations of one or more enhancement techniques.

The microgap heights and taper angles are important consideration. The microgap heights may be from 10 micrometers to 10 mm or larger. The taper angle may vary from 1 degree to 50 degrees. A preferred range is from 3 degrees to 30 degrees. These parameters are adjusted to provide a pumping action from expanding bubbles at a given heat flux. At lower heat fluxes, the bubbles may not be expanding rapidly, thereby requiring a smaller taper angle. At higher heat fluxes, use of a higher taper angle may be desirable as it will provide the bubble squeezing action during the corresponding rapid bubble growth and expansion.

The dimension of the common liquid inlet and liquid and vapor outlet ports are also important considerations. The slots may be of widths ranging from 10 micrometers to 10 mm, or preferably in the 500 micrometers to 3 mm range. The slots may be continuous or discontinuous of certain lengths normal to flow direction in the microgap. The slots may be replaced with holes or other types of openings. The microgap region may be circular in other embodiments.

The manifold surface facing the bulk liquid may be contoured to provide smooth entry of the liquid into the inlet ports. The inlet and outlet ports and the manifolds may be appropriately contoured to reduce the flow resistance to the flowing fluids.

Example 1—Pool Boiling with Dual Taper

The pool boiling experimental study was conducted using a dual taper configuration as shown in FIG. 9A, where a single inlet port serves two adjacent tapered manifolds. The liquid flows through two adjacent inlet sections of the two microgaps and liquid and vapor exits the two microgaps through the two outlet sections. The manifold block with the dual taper is secured on a plain copper substrate (10 mm×10 mm). Water was used at the working at 1 atmosphere pressure. Two dual taper angles were tested; 10° and 15°. The microgap between the heated surface and tapered manifold is created by the combination of a highly compressible silicone gasket and a steel plate. The steel plate used had thickness 1024 μm. The performance of dual tapers is compared boiling performance of copper substrate without any manifold block.

Figure 13:
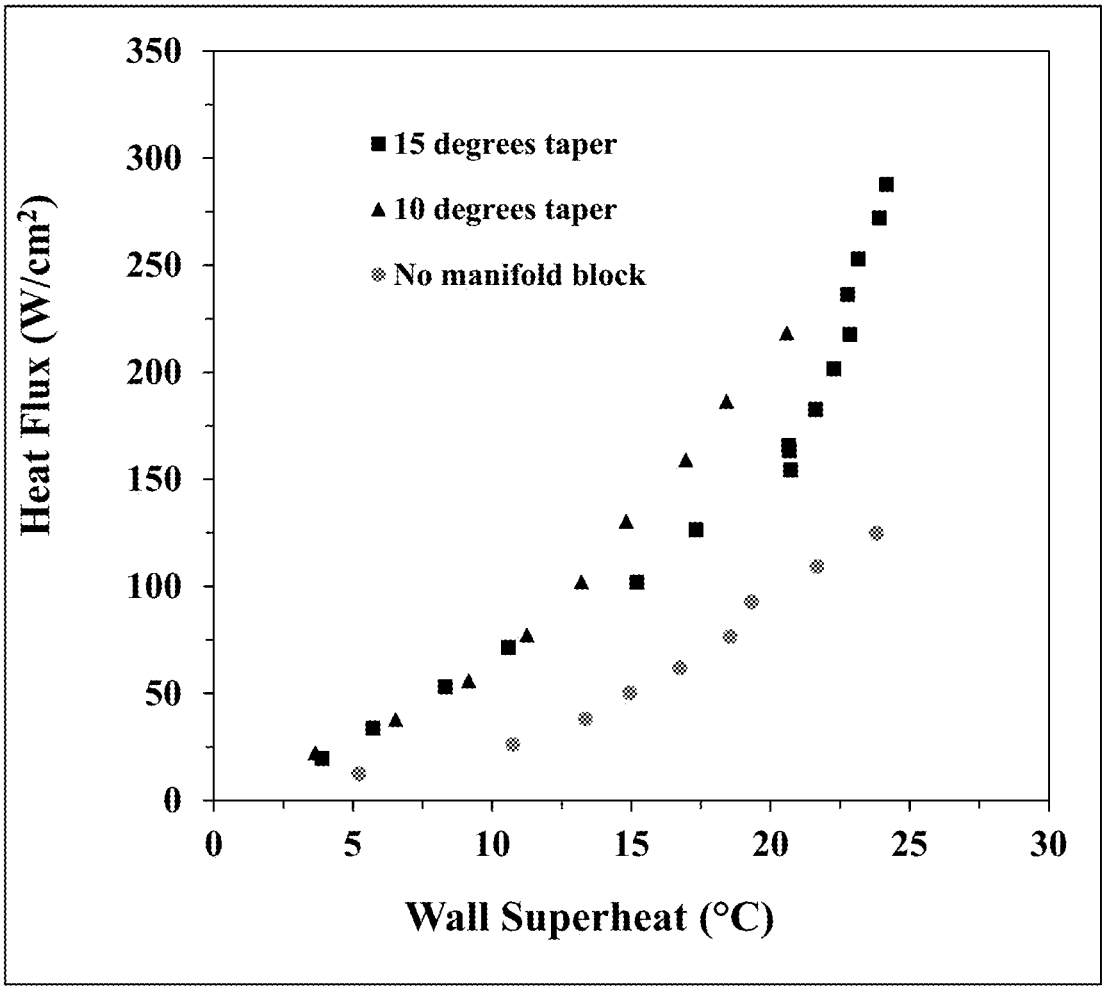
FIG. 13 is the plot showing variation in heat flux dissipated with wall superheat during pool boiling using dual taper on copper substrate.

The heat flux dissipated was plotted against wall superheat as shown in FIG. 13. The highest critical heat flux (CHF) achieved was 288 W/cm$^2$ using 15° dual taper at wall superheat 24.1° C. The configuration with 10° dual taper achieved CHF 218 W/cm$^2$ at wall superheat of 20.5° C. The configuration without any manifold block achieved CHF at 124 W/cm$^2$ at wall superheat 23.8° C.

Figure 14:
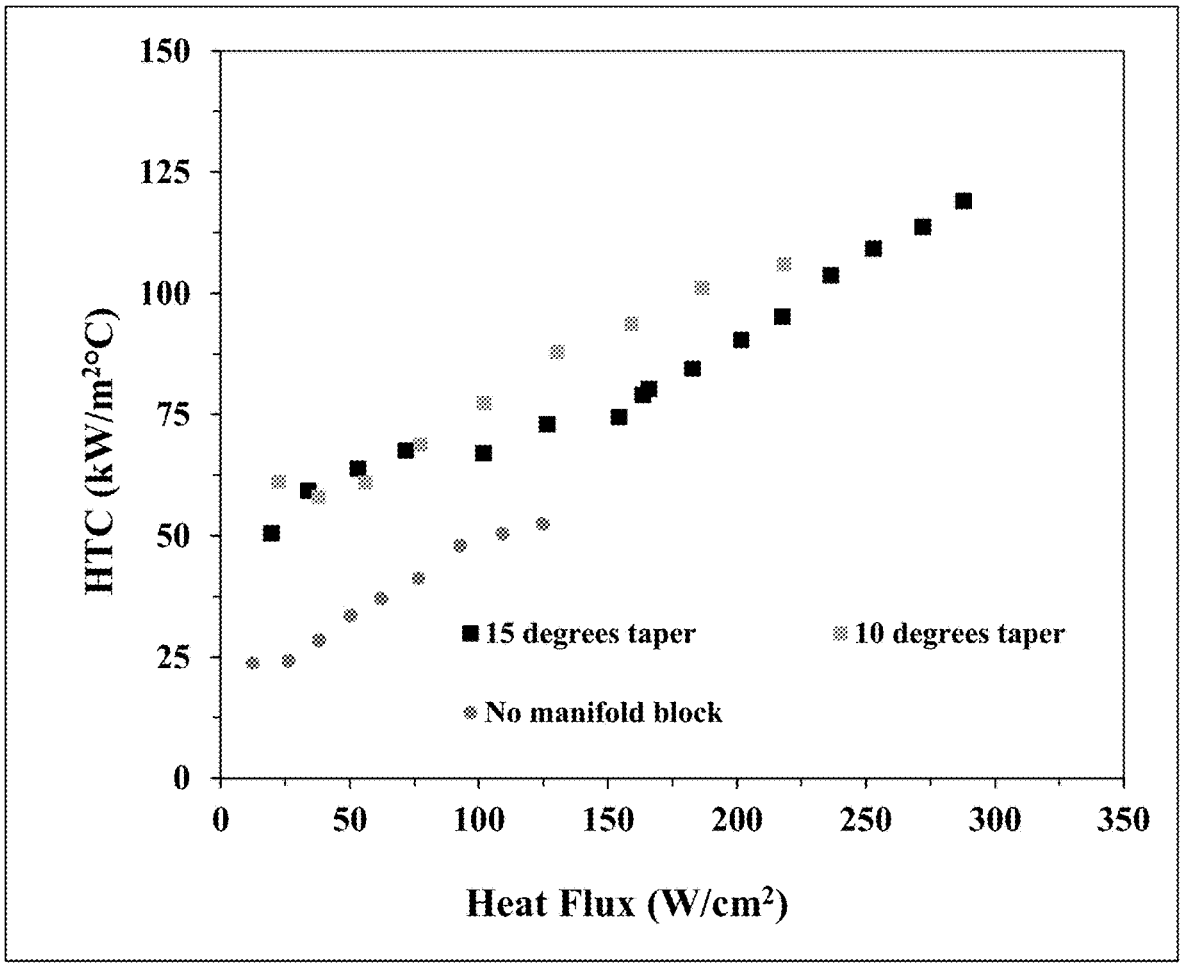
FIG. 14 is a plot showing variation in heat transfer coefficient (HTC) with heat flux dissipated during pool boiling using dual taper on copper substrate.

The heat transfer coefficient (HTC) was plotted against heat flux as shown in FIG. 14. The HTC defines the heat dissipation efficiency of the system. Highest HTC was achieved was 119 kW/m$^{2\circ}$ C. for 15° dual taper. 10° dual taper achieved maximum HTC value of 106 kW/m$^{2\circ}$ C. The lowest HTC was achieved for no manifold block configuration, 52.5 kW/m$^{2\circ}$ C. The CHF and HTC values show that dual taper manifold can dissipate higher heat fluxes more efficiently.

Example 2—Dual Taper Design in a Thermosiphon Loop

A dual taper design with pool boiling is employed in a thermosiphon loop used in cooling of a server in data center application.

Example 3—Dual Taper Design in a Vapor Chamber Application

A dual taper is design is employed in a vapor chamber for computer chip cooling application.

Geometric Considerations

The taper angle and the microgap are important geometric parameters need to be considered to design a boiling system using tapered manifold. The following theroretical approach can be used to estimate the heat transfer coefficient of boiling system and evaluate the efficiency of heat transfer.

To estimate the heat transfer coefficient, Kandlikar's flow boiling correlation is used. Mass flow rate in the correlation is calculated using the pressure drop equation along the flow length.

The following equation (1) shows the relation between exit quality (x), heat flux (q"), latent heat of vaporization ($h_{fg}$), surface area of the heated substrate (A), and liquid mass flow rate ($\dot{m}$)

$$x = \frac{1}{h_{fg}}\left[\left(\frac{q''A}{\dot{m}}\right)\right] \tag{1}$$

The two phase viscosity ($\mu_{tp}$) can be calculated using equation (2), where $\mu_g$ is vapor viscosity and $\mu_f$ is liquid viscosity.

$$\frac{1}{\mu_{tp}} = \frac{x}{\mu_g} + \frac{1-x}{\mu_f} \tag{2}$$

The two pressure drops components in the system are due to friction, and momentum change during phase change. The following integrated equation (3) with friction and momentum components can be used to estimate the pressure drop.

$$\int_0^{L_{tp}} -\left(\frac{dP}{dz}\right)dz = \frac{\frac{2f_{TP}G^2v_f}{D_h}\left[1 + x\left(\frac{v_{fg}}{v_f}\right)\right] + G^2v_{fg}\frac{dx}{dz}}{1 + G^2x\left(\frac{dv_g}{dp}\right)} \tag{3}$$

$v_f$ is the specific volume of the liquid, $v_{fg}$ is the difference in the specific volume of saturated liquid and vapor, G is the mass flux and $f_{TP}$ is the two phase friction factor, dz is the element along flow length, $L_{tp}$ is the total two phase flow length, $D_h$ is the hydraulic diameter. In the equation (3), the two-phase friction factor ($f_{TP}$) can be calculated using the following equation (4), $$f_{tp} = 0.079\left(\frac{GD_h}{\mu_{tp}}\right)^{-0.25} \tag{4}$$

A tapered manifold is used for pressure recovery. The pressure recovery can be calculated using the following equation (5)

$$-\left(\frac{dP}{dz_{taper,area}}\right) = \frac{\frac{-2G^2v_f}{A_c}\left[1 + x\left(\frac{v_{fg}}{v_f}\right)\right]\frac{dA}{dz}}{1 + G^2x\left(\frac{dv_g}{dp}\right)} \tag{5}$$

In the above equation (5), dA/dz term represents the change in cross sectional area due to taper and is dependent on the taper angle. The pressure drop (calculated using equation 3) is equal to the pressure recovered due to taper. This gives the mass flow rate of liquid ($\dot{m}$).

The two phase heat transfer coefficient ($h_{TP}$) can be calculated using Kandlikar's correlation (S. G. Kandlikar; A General Correlation for Saturated Two-Phase Flow Boiling Heat Transfer Inside Horizontal and Vertical Tubes, 1990) as shown in equation (6)

$$\frac{h_{TP}}{h_l} = C_1C_o^{C_2}(25Fr_{lo})^{C_5} + C_3B_o^{C_4}F_{fl} \tag{6}$$

$C_o$ is the convection number, $B_o$ is the boiling number, $Fr_{lo}$ is the Froude number, $F_{fl}$ is the fluid dependent parameter, and $C_1$-$C_5$ are the constants, and $h_l$ is the single phase liquid only heat transfer coefficient, which can be calculated using the following equation (7)

$$h_l = 0.023Re_l^{0.8}Pr_l^{0.4}(k_l/D) \tag{7}$$

For two phase flow in narrow channels, other appropriate equations can be used in place of Kandlikar correlation, such as Kandlikar and Balasubramanian (S. G Kandlikar, P Balasubramanian; An Extension of the Flow Boiling Correlation to Transition, Laminar, and Deep Laminar Flows in Minichannels and Microchannels, 2010).

The tapered manifold design can be optimized by evaluating the heat transfer coefficient for different geometric parameters. The aim is to maximize the heat transfer coefficient for any heat transfer system. The exit quality is preferred to be less than 0.8 and even more preferred to be less than 0.5 for safe operations.

Having thus described the basic concept of the invention, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefore, is not intended to limit the claimed processes to any order except as may be specified in the claims. Accordingly, the invention is limited only by the following claims and equivalents thereto.

What is claimed:

1. A method for pool boiling, comprising:

introducing a liquid into a chamber of a housing, wherein the chamber comprises a heat transfer surface, comprising one or more protruding features which form channels, and a first asymmetric diverter positioned over the heat transfer surface and extending at least partially across the one or more protruding features in the chamber and a passageway between the heat transfer surface and the asymmetric diverter;

forming, at one or more nucleation sites on the heat transfer surface, one or more bubbles in the liquid on the surface of the chamber at the one or more bubble nucleation sites; and enhancing the flow of the liquid through the channels by redirecting with the first asymmetric diverter the growth and path of one of the one or more bubbles preferentially in one direction as they form and grow so that the one or more bubbles push liquid out away from the growing one or more bubbles, wherein the one or more bubbles escape out of the passageway only out one side of the first asymmetric diverter causing liquid to flow into the passageway in the other side of the first asymmetric diverter, wherein the liquid flow is caused without an external pumping mechanism and wherein the liquid flow improves heat transfer and increases the critical heat flux limit.

2. The method of claim 1, further comprising:

introducing the liquid into the chamber of the housing, wherein the chamber comprises a second asymmetric diverter positioned over the heat transfer surface and extending at least partially across the one or more protruding features in the chamber, arranged adjacent to the first diverter to form a shared first opening between the first and second diverters and a passageway between the heat transfer surface and the first and second diverters; and enhancing the flow of the liquid through the channels by redirecting with the first and second diverters the growth and path of one of the one or more bubbles preferentially in one direction as they form and grow so that the one or more bubbles push liquid out away from the growing one or more bubbles, wherein the one or more bubbles escape out of the passageway only through the shared first opening between adjacent diverters causing liquid flow into the passageway around the other side of each of the first and second diverters or the one or more bubbles escape out of the passageway only around the other side of each of the first and second diverters causing liquid flow into the passageway through the shared first opening between the first and second diverters.

3. The method of claim 2, further comprising:

introducing the liquid into the chamber of the housing, wherein the chamber comprises three or more asymmetric diverters positioned over the heat transfer surface and extending at least partially across the one or more protruding features in the chamber, arranged adjacent to one another with a diverter at each end, wherein each diverter between the end diverters forms a shared opening on one side with an adjacent diverter and a shared opening on the other side with an adjacent diverter and a passageway between the heat transfer surface and the three or more asymmetric diverters; and enhancing the flow of the liquid through the channels by redirecting with each one of the three or more diverters the growth and path of one of the one or more bubbles preferentially in one direction as they form and grow so that the one or more bubbles push liquid out away from the growing one or more bubbles, wherein the one or more bubbles escape out of the passageway only through the shared opening between adjacent diverters causing liquid flow into the passageway around the other side of each of the adjacent diverters or the one or more bubbles escape out of the passageway only around the other side of adjacent diverters causing liquid flow into the passageway through the shared opening between the adjacent diverters.

4. The method as set forth in claim 1, wherein the one or more protruding features comprise one or more fins.

5. The method as set forth in claim 4, wherein the one or more fins are in an offset arrangement in the chamber.

6. The method as set forth in claim 1, wherein the one or more protruding features comprise one or more pins.

7. The method as set forth in claim 1, wherein the forming one or more bubbles further comprises triggering the bubble nucleation in the chamber of the housing to form the one or more bubbles.

8. A pool boiling apparatus comprising:

a housing with a chamber;

a heat transfer surface, comprising one or more protruding features which form channels in the chamber of the housing; and a first asymmetric diverter positioned over the heat transfer surface and extending at least partially across the one or more protruding features in the chamber and a passageway between the heat transfer surface and the asymmetric diverter, wherein the chamber of the housing is configured to form at one or more nucleation sites on the heat transfer surface one or more bubbles as a result of bubble nucleation creating a flow of the liquid on the heat transfer surface from which they have formed and wherein the first asymmetric diverter redirects the growth and path of the one or more bubbles preferentially in one direction as they form and grow so that the one or more bubbles push liquid out away from the growing one or more bubbles, wherein the one or more bubbles escape out of the passageway only out one side of the first asymmetric diverter causing liquid to flow into the passageway in the other side of the first asymmetric diverter, without an external pumping mechanism so as to improve heat transfer to the liquid and increase the critical heat flux limit.

9. The apparatus of claim 8, further comprising:

a second asymmetric diverter positioned over the heat transfer surface and extending at least partially across the one or more protruding features in the chamber, arranged adjacent to the first diverter to form a shared first opening between the first and second diverters and a passageway between the heat transfer surface and the first and second diverters;

wherein the chamber of the housing is configured to enhance the flow of the liquid through the channels by redirecting with the first and second diverters the growth and path of one of the one or more bubbles preferentially in one direction as they form and grow so that the one or more bubbles push liquid out away from the growing one or more bubbles, wherein the one or more bubbles escape out of the passageway only through the shared first opening between adjacent diverters causing liquid flow into the passageway around the other side of each of the first and second diverters or the one or more bubbles escape out of the passageway only around the other side of each of the first and second diverters causing liquid flow into the passageway through the shared first opening between the first and second diverters.

10. The apparatus of claim 9, further comprising:

three or more asymmetric diverters positioned over the heat transfer surface and extending at least partially across the one or more protruding features in the chamber, arranged adjacent to one another with a diverter at each end, wherein each diverter between the end diverters forms a shared opening on one side with an adjacent diverter and a shared opening on the other side with an adjacent diverter and a passageway between the heat transfer surface and the three or more asymmetric diverters;

wherein the chamber of the housing is configured to enhance the flow of the liquid through the channels by redirecting with each one of the three or more diverters the growth and path of one of the one or more bubbles preferentially in one direction as they form and grow so that the one or more bubbles push liquid out away from the growing one or more bubbles, wherein the one or more bubbles escape out of the passageway only through the shared opening between adjacent diverters causing liquid flow into the passageway around the other side of each of the adjacent diverters or the one or more bubbles escape out of the passageway only around the other side of adjacent diverters causing liquid flow into the passageway through the shared opening between the adjacent diverters.

11. The apparatus of claim 8, wherein the one or more protruding features comprise one or more fins.

12. The apparatus of claim 11, wherein the one or more fins are in an offset arrangement in the chamber.

13. The apparatus of claim 8, wherein the one or more protruding features comprise one or more pins.

14. The apparatus of claim 8, wherein at least one of the chamber of the housing with the one or more protruding features and the diverter is configured to trigger the bubble nucleation in the chamber of the housing to form the one or more bubbles.

15. A method for pool boiling, comprising:

introducing a liquid into a chamber of a housing, wherein the chamber comprises a heat transfer surface, a first asymmetric diverter positioned over the heat transfer surface and a microgap between the heat transfer surface and the first asymmetric diverter;

forming, at one or more nucleation sites on the heat transfer surface, one or more bubbles in the liquid on the surface of the chamber at the one or more bubble nucleation sites; and enhancing the flow of the liquid by redirecting with the first asymmetric diverter the growth and path of one of the one or more bubbles preferentially in one direction as they form and grow so that the one or more bubbles push liquid out away from the growing one or more bubbles, wherein the one or more bubbles escape out of the microgap only out one side of the first asymmetric diverter causing liquid to flow into the microgap in the other side of the first asymmetric diverter, wherein the liquid flow is caused without an external pumping mechanism and wherein the liquid flow improves heat transfer and increases the critical heat flux limit.

16. The method of claim 15, further comprising:

introducing the liquid into the chamber of the housing, wherein the chamber comprises a second asymmetric diverter positioned over the heat transfer surface arranged adjacent to the first diverter to form a shared first opening between the first and second diverters, the microgap between the heat transfer surface and the first and second diverters; and enhancing the flow of the liquid by redirecting with the first and second diverters the growth and path of one of the one or more bubbles preferentially in one direction as they form and grow so that the one or more bubbles push liquid out away from the growing one or more bubbles, wherein the one or more bubbles escape out of the microgap only through the shared first opening between adjacent diverters causing liquid flow into the microgap around the other side of each of the first and second diverters or the one or more bubbles escape out of the microgap only around the other side of each of the first and second diverters causing liquid flow into the microgap through the shared first opening between the first and second diverters.

17. The method of claim 16, further comprising:

introducing the liquid into the chamber of the housing, wherein the chamber comprises three or more asymmetric diverters positioned over the heat transfer surface arranged adjacent to one another with a diverter at each end, wherein each diverter between the end diverters forms a shared opening on one side with an adjacent diverter and a shared opening on the other side with an adjacent diverter and the microgap between the heat transfer surface and the three or more asymmetric diverters; and enhancing the flow of the liquid by redirecting with each one of the three or more diverters the growth and path of one of the one or more bubbles preferentially in one direction as they form and grow so that the one or more bubbles push liquid out away from the growing one or more bubbles, wherein the one or more bubbles escape out of the microgap only through the shared opening between adjacent diverters causing liquid flow into the microgap around the other side of each of the adjacent diverters or the one or more bubbles escape out of the microgap only around the other side of adjacent diverters causing liquid flow into the microgap through the shared opening between the adjacent diverters.

18. The method of claim 17, further comprising protruding features on the heat transfer surface located beneath the microgap.

19. A pool boiling apparatus comprising:

a housing with a chamber;

a heat transfer surface;

a first asymmetric diverter positioned over the heat transfer surface and a microgap between the heat transfer surface and the first asymmetric diverter, wherein the chamber of the housing is configured to form at one or more nucleation sites on the heat transfer surface one or more bubbles as a result of bubble nucleation creating a flow of the liquid on the heat transfer surface from which they have formed and wherein the first asymmetric diverter redirects the growth and path of the one or more bubbles preferentially in one direction as they form and grow so that the one or more bubbles push liquid out away from the growing one or more bubbles, wherein the one or more bubbles escape out of the microgap only out one side of the first asymmetric diverter causing liquid to flow into the microgap in the other side of the first asymmetric diverter, without an external pumping mechanism so as to improve heat transfer to the liquid and increase the critical heat flux limit.

20. The apparatus of claim 19, further comprising:

a second asymmetric diverter positioned over the heat transfer surface and arranged adjacent to the first diverter to form a shared first opening between the first and second diverters and the microgap between the heat transfer surface and the first and second diverters;

wherein the chamber of the housing is configured to enhance the flow of the liquid through the channels by redirecting with the first and second diverters the growth and path of one of the one or more bubbles preferentially in one direction as they form and grow so that the one or more bubbles push liquid out away from the growing one or more bubbles, wherein the one or more bubbles escape out of the microgap only through the shared first opening between adjacent diverters causing liquid flow into the microgap around the other side of each of the first and second diverters or the one or more bubbles escape out of the microgap only around the other side of each of the first and second diverters causing liquid flow into the microgap through the shared first opening between the first and second diverters.

* * * * *